US012371892B2

(12) United States Patent
Zhang et al.

(10) Patent No.: US 12,371,892 B2
(45) Date of Patent: Jul. 29, 2025

(54) DRAIN ASSEMBLIES, AND RELATED KITS AND METHODS

(71) Applicant: Oatey Co., Cleveland, OH (US)

(72) Inventors: Kai Zhang, Olmsted Falls, OH (US); Christopher Dodd, Lakewood, OH (US)

(73) Assignee: OATEY CO., Cleveland, OH (US)

( * ) Notice: Subject to any disclaimer, the term of this patent is extended or adjusted under 35 U.S.C. 154(b) by 272 days.

(21) Appl. No.: 18/105,592

(22) Filed: Feb. 3, 2023

(65) Prior Publication Data

US 2023/0313518 A1 Oct. 5, 2023

Related U.S. Application Data

(60) Provisional application No. 63/326,198, filed on Mar. 31, 2022.

(51) Int. Cl.
*E03F 5/04* (2006.01)

(52) U.S. Cl.
CPC ..... *E03F 5/0407* (2013.01); *E03F 5/041* (2013.01)

(58) Field of Classification Search
CPC ..... E03F 5/0407; E03F 5/041
USPC ..... 4/286, 256.1, 292, 295, 652, 287, 290
See application file for complete search history.

(56) References Cited

U.S. PATENT DOCUMENTS 6,108,828 A * 8/2000 Cheng ..... A47K 1/14 4/286
6,637,464 B1 10/2003 Cornwall
6,725,468 B2 4/2004 Molina
7,213,274 B2 5/2007 Cotton et al.
7,533,499 B2 5/2009 Daigger et al.
7,624,759 B1 * 12/2009 Ismert ..... E03C 1/22 4/293
7,699,981 B2 4/2010 Ledford et al.
7,735,512 B1 * 6/2010 Ismert ..... E04G 15/061 137/362
7,964,095 B1 6/2011 Graybeal
8,043,497 B2 10/2011 Silverstein et al.
8,347,424 B2 1/2013 Wroblewski et al.
(Continued)

FOREIGN PATENT DOCUMENTS

AU 2018273738 B2 1/2011
CA 2437871 A1 2/2004
(Continued)

*Primary Examiner* — Lori L Baker
(74) *Attorney, Agent, or Firm* — BakerHostetler

(57) ABSTRACT

A drain assembly includes a drain body, barrel, plug, and sleeve. The drain body has an interior surface defining a channel along an axis and having interior threads thereon. The barrel has a central body having an upper end, with a flange extending radially outward therefrom and defining a landing surface. The central body has opposed exterior and interior barrel surfaces having exterior and interior threads, respectively. The interior barrel surface defines a channel alignable with the axis. The exterior threads are engageable with the drain body interior threads for axially adjusting the barrel relative to the drain body. The plug has a top surface and an outer body extending axially downward to a stop surface. An inner portion of the outer body extends axially below the stop surface and has external threads engageable with the barrel interior threads. The sleeve is sealingly receivable between the stop and landing surfaces.

14 Claims, 26 Drawing Sheets

(56) References Cited

U.S. PATENT DOCUMENTS

| | | | | |
|---|---|---|---|---|
| 8,347,906 | B1 * | 1/2013 | Ismert | E04G 15/061 4/293 |
| 8,658,033 | B2 | 2/2014 | Farkas | |
| 8,881,490 | B2 | 11/2014 | Wroblewski et al. | |
| 9,080,324 | B2 * | 7/2015 | Eriksson | E03F 5/0409 |
| 9,322,157 | B1 | 4/2016 | Ismert | |
| 9,422,708 | B2 | 8/2016 | Hull | |
| 9,453,331 | B1 | 9/2016 | Buffington | |
| 9,657,469 | B2 | 5/2017 | Edmonds et al. | |
| 9,743,653 | B2 | 8/2017 | Sarnowski et al. | |
| 10,060,109 | B2 | 8/2018 | Edmonds et al. | |
| 10,167,622 | B2 | 1/2019 | Brooks et al. | |
| 10,184,238 | B2 | 1/2019 | Hull | |
| 10,208,884 | B2 | 2/2019 | Honeyball | |
| 10,370,841 | B2 | 8/2019 | Huber | |
| 10,480,170 | B2 | 11/2019 | Hull | |
| 10,683,654 | B2 | 6/2020 | Priester | |
| 10,711,447 | B2 | 7/2020 | Say et al. | |
| 11,078,658 | B2 | 8/2021 | Say | |
| 11,384,523 | B2 | 7/2022 | Young et al. | |
| 11,946,241 | B2 * | 4/2024 | Lorkowski | E03F 5/0409 |
| 12,012,742 | B2 * | 6/2024 | Henry | B01D 29/35 |
| 12,077,955 | B2 * | 9/2024 | Noonan | E03F 5/0407 |
| 2008/0078126 | A1 | 4/2008 | Ledford et al. | |
| 2010/0133159 | A1 | 6/2010 | Priester | |
| 2011/0296606 | A1 | 12/2011 | Wedi | |
| 2012/0037553 | A1 | 2/2012 | Silverstein et al. | |
| 2014/0138297 | A1 * | 5/2014 | Hull | E03F 5/0407 210/164 |
| 2015/0101120 | A1 | 4/2015 | McLeod | |
| 2015/0292662 | A1 | 10/2015 | Majocka et al. | |
| 2016/0040411 | A1 * | 2/2016 | Carpenter-Crawford | E03C 1/0405 4/292 |
| 2017/0130442 | A1 | 5/2017 | Brooks et al. | |
| 2018/0073237 | A1 | 3/2018 | Say et al. | |
| 2018/0155914 | A1 | 6/2018 | Coronado et al. | |
| 2019/0316334 | A1 | 10/2019 | Larson | |
| 2019/0316341 | A1 | 10/2019 | Say | |
| 2020/0080672 | A1 | 3/2020 | DeGooyer | |
| 2020/0173160 | A1 | 6/2020 | Meyers et al. | |
| 2020/0284019 | A1 | 9/2020 | Meyers et al. | |
| 2020/0340230 | A1 | 10/2020 | Say et al. | |
| 2023/0125638 | A1 * | 4/2023 | Rosario | E03C 1/2302 4/287 |
| 2023/0148123 | A1 * | 5/2023 | Sapp | E03C 1/262 4/287 |

FOREIGN PATENT DOCUMENTS

| | | | | |
|---|---|---|---|---|
| CA | 2657148 | A1 | 9/2009 | |
| CA | 2752360 | A1 | 3/2013 | |
| CA | 2803994 | A1 | 7/2013 | |
| CA | 2831508 | A1 * | 4/2014 | E03F 5/0407 |
| CA | 2852720 | A1 | 10/2015 | |
| CA | 2947709 | A1 | 5/2017 | |
| CA | 2978862 | A1 | 3/2018 | |
| CA | 3021711 | A1 | 4/2019 | |
| CA | 3040299 | A1 | 10/2019 | |
| CA | 3052496 | A1 | 3/2020 | |
| CA | 3188679 | A1 * | 8/2023 | E03F 5/0407 |
| CN | 117661699 | A * | 3/2024 | E03F 5/0407 |
| WO | WO-2015112234 | A1 * | 7/2015 | E03F 5/0404 |
| WO | 2018/067015 | A1 | 4/2018 | |
| WO | 2019/040970 | A1 | 3/2019 | |
| WO | 2019/161874 | A1 | 8/2019 | |
| WO | 2020/117436 | A1 | 6/2020 | |

* cited by examiner

Fig.5A
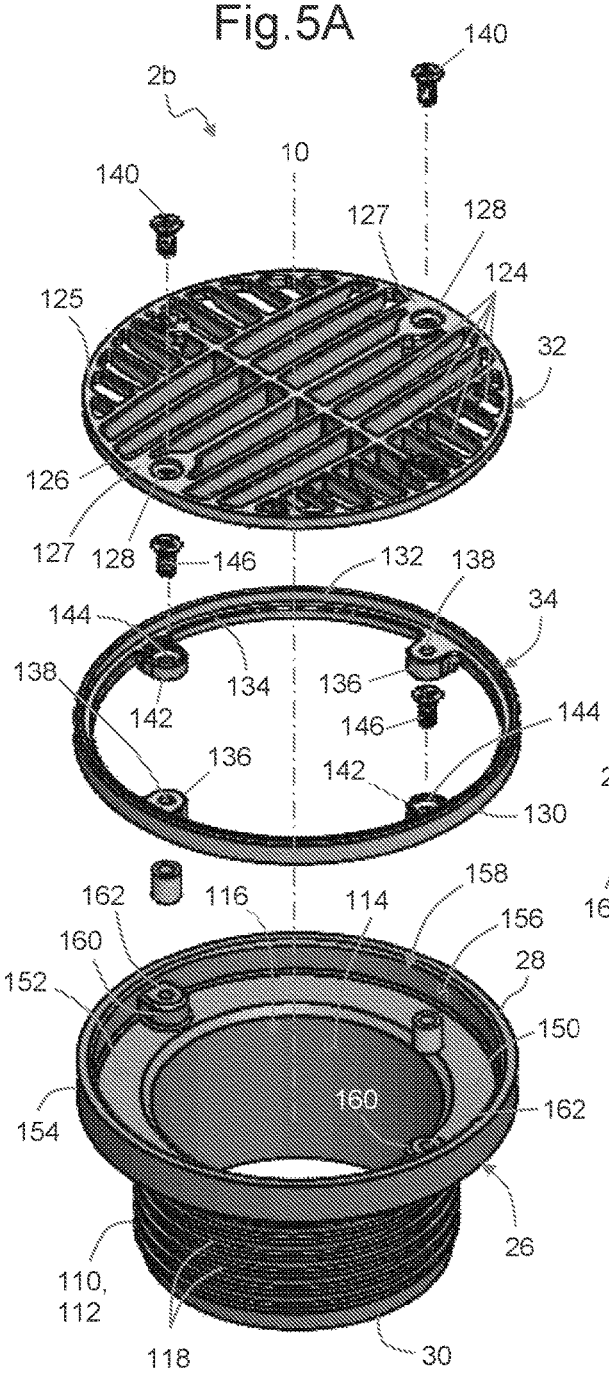
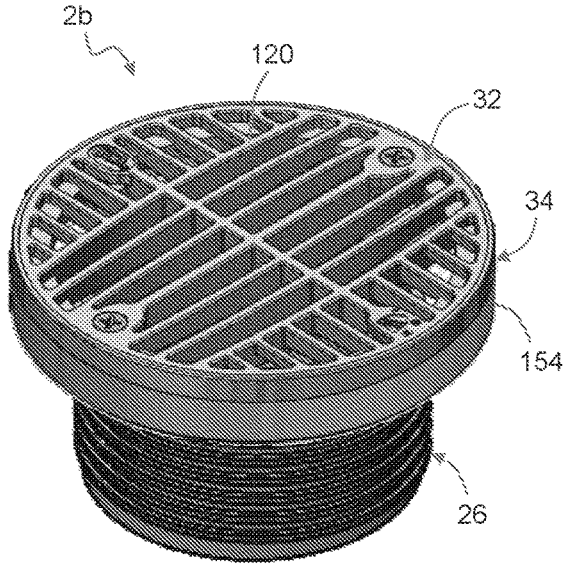
Fig.5B
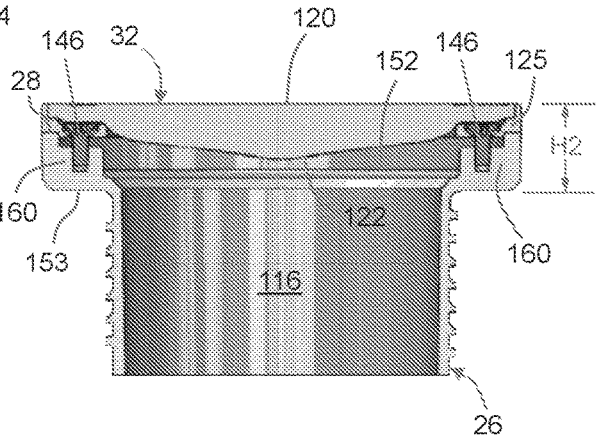
Fig.5C

DRAIN ASSEMBLIES, AND RELATED KITS AND METHODS

CROSS-REFERENCE TO RELATED APPLICATIONS

The present application claims the benefit of U.S. Provisional Application No. 63/326,198, filed Mar. 31, 2022, in the name of Zhang et al., the entire contents of which are incorporated herein by this reference.

TECHNICAL FIELD

The disclosure relates generally to relates to drains, and more particularly to drain assemblies that are adaptable to various types of drain installation techniques.

BACKGROUND

Drain assemblies and drain assembly kits are commonly provided with features that allow adaptability, which can include providing various components that are interchangeable based on the type of drain installation technique to be employed. Some common, non-limiting examples of drain installations include on-grade, cored opening, and waterproofing installations. On-grade drain installations involve placing an assembled or partially assembled drain assembly relative to a construction substrate and forming a floor around the placed drain assembly. In such installations, the floor is commonly formed by pouring wet cement over the construction substrate to a grade depth that is generally level with an upper most surface of the drain assembly. Similar types of drain installations can involve above-grade and below grade floor formation. Cored opening drain installations typically involve suspending an assembled or partially assembled drain assembly over an opening pre-formed in a substrate, such as hardened cement, wood flooring, decking, corrugate metal, and the like. Waterproofing drain installations typically involve placing a partially assembled drain assembly in an opening formed in a substrate and clamping a waterproof membrane to the drain assembly. A floor material in a liquid phase can then be formed (e.g., poured) over the waterproof membrane and around the drain assembly.

Because of the wide variety of construction parameters for these and other types of drain installations, a user must typically pre-select drain assemblies having a multitude of specific parameters, which can later prove inadequate if the floor construction adjacent the drain installation has deficiencies. Drain assemblies that are adjustable and employ interchangeable components can provide significant benefits in relation to avoiding costly re-installations.

SUMMARY

According to an embodiment of the present disclosure, a drain assembly includes a drain body, barrel, plug, and sleeve. The drain body has an interior surface defining a channel along an axis and having interior threads thereon. The barrel has a central body having an upper end, with a flange extending radially outward therefrom and defining a landing surface. The central body has opposed exterior and interior barrel surfaces having exterior and interior threads, respectively. The interior barrel surface defines a channel alignable with the axis. The exterior threads are engageable with the drain body interior threads for axially adjusting the barrel relative to the drain body. The plug has a top surface and an outer body extending axially downward to a stop surface. An inner portion of the outer body extends axially below the stop surface and has external threads engageable with the barrel interior threads. The sleeve is sealingly receivable between the stop and landing surfaces.

BRIEF DESCRIPTION OF THE DRAWINGS

The foregoing summary, as well as the following detailed description of illustrative embodiments of the present application, will be better understood when read in conjunction with the appended drawings. For the purposes of illustrating the features of the present application, there is shown in the drawings illustrative embodiments. It should be understood, however, that the application is not limited to the precise arrangements and instrumentalities shown. In the drawings:

FIG. 5A is an exploded perspective view of the post-pour sub-assembly shown in FIG. 1.

FIG. 5B is a perspective view of the post-pour sub-assembly shown in FIG. 5A.

FIG. 5C is a sectional side view of the post-pour sub-assembly shown in FIG. 5B.

FIG. 6A shows the post-pour sub-assembly level with a top surface of hardened cement. FIG. 6B shows the post-pour sub-assembly axially adjusted below the top surface of the hardened cement.

DETAILED DESCRIPTION OF ILLUSTRATIVE EMBODIMENTS

The present disclosure can be understood more readily by reference to the following detailed description taken in connection with the accompanying figures and examples, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the scope of the present disclosure. Also, as used in the specification including the appended claims, the singular forms "a," "an," and "the" include the plural, and reference to a particular numerical value includes at least that particular value, unless the context clearly dictates otherwise.

The terms "understood", "understand", and derivatives thereof, as used herein, refer to a level of understanding expected of a person having ordinary skill in the art of drains.

The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

The terms "approximately", "about", and "substantially", as used herein with respect to dimensions, angles, ratios, and other geometries, takes into account manufacturing tolerances. Further, the terms "approximately", "about", and "substantially" can include 10% greater than or less than the stated dimension, ratio, or angle. Further, the terms "approximately", "about", and "substantially" can equally apply to the specific value stated.

It should be understood that, although numerical prefaces (e.g., first, second, third) can be used herein to describe various features, such features should not be limited by these prefaces. These prefaces are instead used to distinguish one feature from another. For example, a "first" element could be termed a "second" element in another context, and, similarly, a "second" element could be termed a "first" element in another context without departing from the scope of the embodiments disclosed herein.

Figure 1:
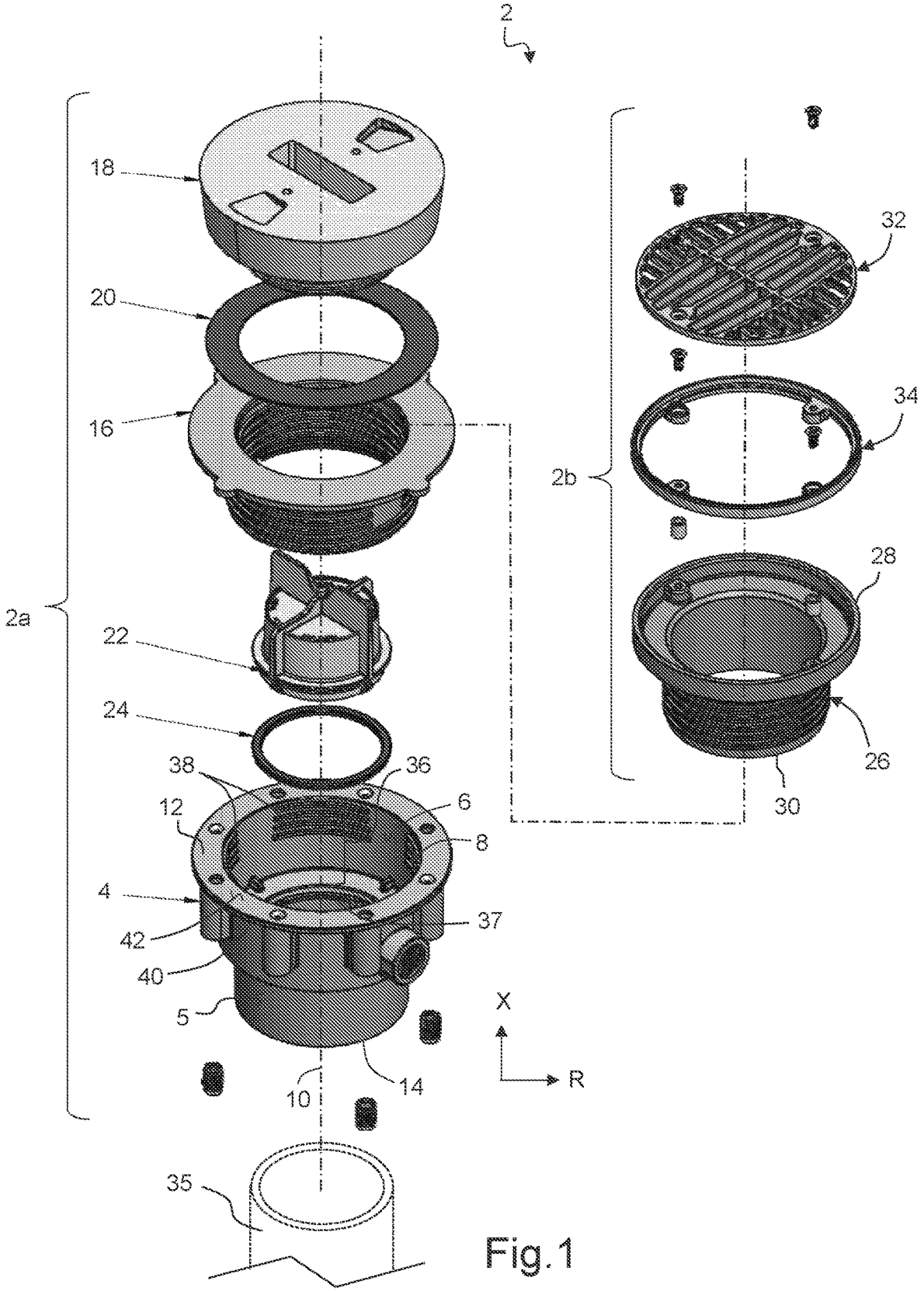
FIG. 1 is an exploded perspective view of an exemplary embodiment of a drain assembly that includes a drain body and an adjustable-height upper barrel. The drain assembly has a pre-pour sub-assembly and a post-pour sub-assembly that is interchangeable with at least one component of the pre-pour sub-assembly.

Referring now to FIG. 1, an exemplary embodiment of a drain assembly 2 having various installation features is shown. The drain assembly 2 is positioned in a floor for transporting water, fluids, debris, or the like through a drain pipe 35. The drain assembly 2 is suitable for drain installations where cement (or other hardenable floor materials) is poured around select components of the drain assembly 2 that are assembled in a first operative configuration.

The drain assembly 2 is configured to be assembled into the first operative configuration (see FIGS. 2D and 3B-3C) during a pre-pour phase of drain installation. The drain assembly 2 is further configured to be partially re-assembled into a second operative configuration (see FIGS. 6A-6B) during a post-pour phase of drain installation, which occurs after the cement has been poured and allowed to harden. In the illustrated embodiment, the drain assembly 2 includes a pre-pour sub-assembly 2*a* of components that are configured to be assembled into the first operative configuration. The drain assembly 2 also includes a post-pour sub-assembly 2*b* of components. At least one component of the pre-pour sub-assembly 2*a* is interchangeable with the post-pour sub-assembly 2*b* for re-configuring the drain assembly 2 into the second operative configuration, as described in more detail below.

During the pre-pour phase, the pre-pour sub-assembly 2*a* can be assembled into the first operative configuration and fitted atop a drain pipe 35, which then holds the assembled pre-pour sub-assembly 2*a* in place over a substrate 52, such as a gravel bed (see FIG. 2D), decking, or the ground, by way of non-limiting examples. With the pre-pour sub-assembly 2*a* held in place by the drain pipe 35, wet cement can be poured around the drain pipe 35 and the pre-pour sub-assembly 2*a* and preferably up to a level substantially in alignment with an uppermost end of the pre-pour sub-assembly 2*a*. Accordingly, the drain assembly 2 of the illustrated embodiment can be referred to as an "on-grade" drain assembly 2. The pre-pour sub-assembly 2*a* has axially adjustable components for adjusting a desired height at which the uppermost end of the pre-pour sub-assembly 2*a* resides over the substrate 52 prior to pouring the cement, as described in more detail below. The desired height of the uppermost end of the pre-pour sub-assembly 2*a* can be determined by a number of factors, such as the intended pour depth of the cement above the substrate 52, by way of a non-limiting example.

The pre-pour sub-assembly 2*a* includes a drain body 4 and an upper barrel 16 that is partially receivable within a drain channel 8 defined within the drain body 4. The pre-pour sub-assembly 2*a* includes a cap plug 18 that is partially insertable within the upper barrel 16 for, among other things, protecting the pre-pour sub-assembly 2*a* and preventing poured cement from entering the upper barrel 16. The pre-pour sub-assembly 2*a* also includes a plug gasket 20 receivable between respective portions of the cap plug 18 and the upper barrel 16 for providing a seal between the cap plug 18 and the upper barrel 16. It should be understood that the cap plug 18 and the plug gasket 20 are interchangeable with the post-pour sub-assembly 2*b* during the post-pour phase of drain installation, as described in more detail below.

The pre-pour sub-assembly 2*a* also includes a test plug 22 insertable within the drain channel 8. The test plug 22 is configured to releasably lock to the drain body 4 within the drain channel 8. The test plug 22 carries a gasket 24 for providing a seal between the test plug 22 and the drain body 4 when the test plug 22 is locked within the drain channel 8, thereby allowing the operation of pressure testing of the drain assembly 2.

The post-pour sub-assembly 2*b* includes a strainer barrel 26 having a top end 28 and an opposed bottom end 30 axially spaced from each other. The bottom end 30 is insertable within the upper barrel 16 and the top end 28 is attachable to a top piece, which in the illustrated embodiment is a strainer grate 32. In the illustrated embodiment, the post-pour sub-assembly 2*b* also includes a support ring 34 for interconnecting the strainer grate 32 to the top end 28 of the strainer barrel 26, as described in more detail below.

With continued reference to FIG. 1, the drain body 4 defines an exterior drain surface 5 and an opposed interior drain surface 6. The interior drain surface 6 defines the drain channel 8, which extends along a central axis 10. In this manner, the central axis 10 is defined by the drain body 4. It should be understood that other components of the drain assembly 2 define respective central axes that substantially align with the central axis 10 when the components are assembled together. For the sake of conciseness, the central axis 10 is used herein synonymously with reference to such other components in their respective assembled orientations. The drain body 4 has a top end 12 and a bottom end 14 opposite each other along an axial direction X that is oriented along the central axis 10. As used herein, the terms "axial," "axially," and derivatives thereof refer to the axial direction X.

Figure 2A:
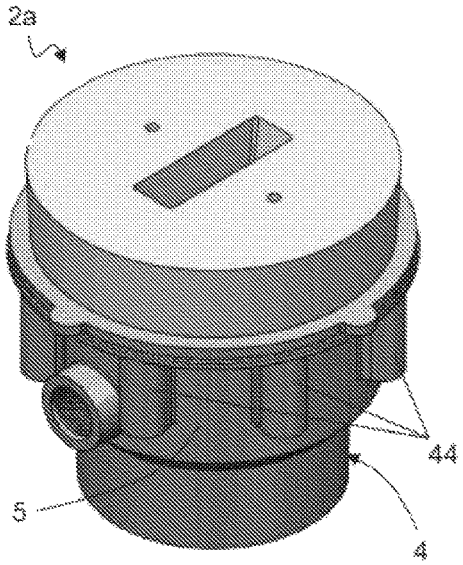
FIGS. 2A and 2B are top and bottom perspective views, respectively, of the pre-pour sub-assembly shown in FIG. 1, assembled in a first operative configuration.
Figure 2B:
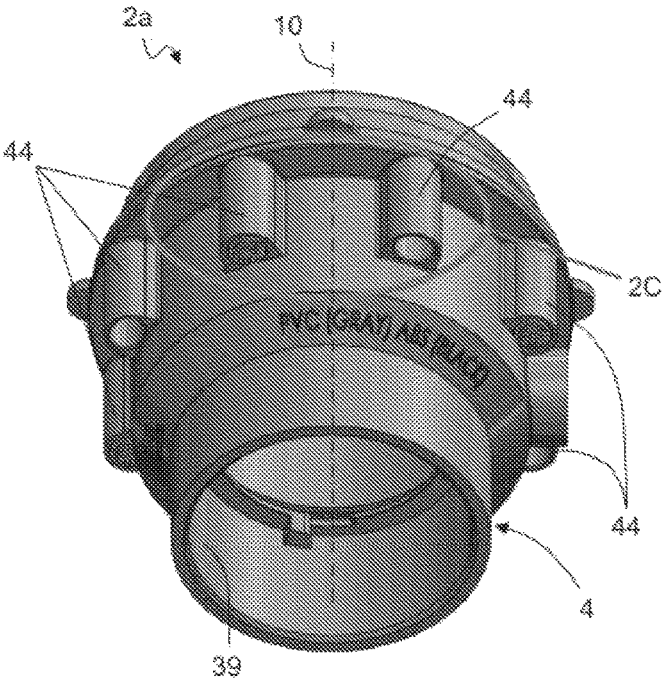
Figure 2C:
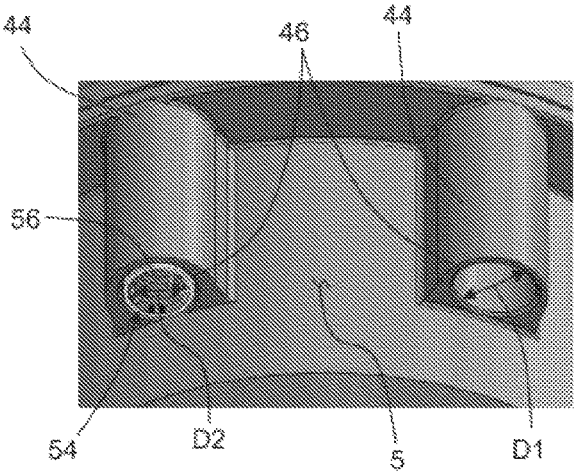
FIG. 2C is an enlarged view of an exterior portion of the drain body shown in FIG. 2B

The drain channel 8 of the drain body 4 extends axially between the top and bottom ends 12 thereof. The exterior drain surface 5 is opposite the interior drain surface 6 with respect to a radial direction R that is perpendicular to the central axis 10. As used herein, the terms "radial," "radially," and derivatives thereof refer to the radial direction R. The bottom end 14 of the drain body 4 is attachable to a drain pipe 35 or other drain plumbing fixture. The interior drain surface 6 includes an upper receptacle portion 36 that extends from the top end 12 to an intermediate portion 37 of the drain body 5. The intermediate portion 37 is located axially between the upper receptacle portion 36 and a lower drain portion 39 (see FIG. 2B) of the interior drain surface 6 that extends axially to the bottom end 14. The upper receptacle portion 36 has interior threads 38 formed therein. The interior threads 38 are complimentary with exterior threads 74 of the upper barrel 16 for allowing the upper barrel 16 to be axially adjustable relative to the drain body 4 while being coupled thereto. This allows for controlling an elevation at which the cap plug 18 resides above the top end 12 of the drain body 4 during the pre-pour phase, as described in more detail below. At the top end 12, the drain body 4 has a drain flange 40 that extends radially outward from the exterior drain surface 5. It should be understood that the drain flange 40 can also be characterized as extending radially outward from the top end 12 of the drain body 4. The drain flange 40 defines an upper surface 42, which is described in more detail below.

Figure 2D:
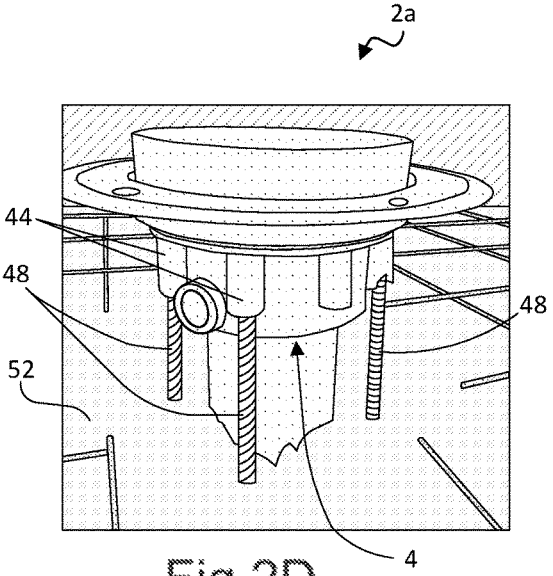
FIG. 2D is a perspective view of a drain installation that includes the pre-pour sub-assembly shown in FIGS. 2A-2B.

Referring now to FIGS. 2A-2D, the drain body 4 includes a plurality of mounting formations 44 that each define a receptacle 46 for receiving respective guide members 48 for aligning the drain body 4 with respect to a floor 50 during the pre-pour phase of drain installation. The guide members 48 extend upwardly from a substrate layer 52 and are receivable within the receptacles 46 for maintaining the drain body 4 in a substantially vertical orientation during the concrete pour, thereby preventing the drain body 4 from tilting or otherwise becoming mis-aligned during concrete pouring. In the illustrated embodiment, the mounting formations 44 extend radially outward from the exterior drain surface 5 and are evenly spaced about the central axis 10. The mounting formations 44 have curved, convex outer surfaces, which are semi-cylindrical and are oriented substantially parallel to the central axis 10. As shown in FIG. 2D, at least some of the guide members 48 can be rebar that are driven into the substrate layer 52, which can be gravel (as shown), dirt, clay, or a synthetic substrate material. In the illustrated embodiment, all of the receptacles 46 have a circular cross-sectional shape and have an inner diameter D1 sized for receiving cylindrical guide members 48, such as rebar. In the illustrated embodiment, the inner diameter D1 is at least ⅜ inch (about 9.5 mm) and is sized for receiving ⅜ inch rebar. At least one of the receptacles 46 can be sized to receive a guide member 48 that comprises external threads, such as a threaded-rod (not shown).

In the illustrated embodiment, the drain body 4 has eight (8) mounting formations 44 that are evenly spaced at 45-degree intervals about the central axis 10. Four (4) of the mounting formations 44 are sized to receive rebar guide members 48 and four (4) of the mounting formations 44 are sized to receive threaded-rod guide members 48. These latter mounting formations 44 include respective inserts 54 that have internal threads 56 that are engageable with the external threads of the threaded-rod guide members 48 for providing fine control of the respective axial positions of the threaded-rod guide members 48 in the associated mounting formations 44. The internal threads 56 of the inserts 54 have a major diameter D2 that allows the internal threads 56 to intermesh with the external threads of the threaded-rod guide members 48. In the illustrated embodiment, the major diameter D2 of the internal threads 56 is at least ⅜ inch (about 9.5 mm). By having mounting formations 44 that are configured to receive various types of guide members 48 (e.g., rebar guide members 48 and threaded-rod guide members 48), the drain body 4 of the illustrated embodiment provides flexible options for aligning the drain body 4 with respect to a floor 50.

It should be understood that the mounting formations 44 described herein can be adapted as needed. Moreover, in other embodiments, any of the quantity, size, shape, and spacing of the mounting formations 44 and their respective receptacles 46 can be varied according to the needs of a particular floor type and/or drain installation. For example, the drain body 4 can have one (1), two (2), three (3), four (4), five (5), six (6), seven (7), nine (9), ten (10), eleven (11), twelve (12), or more than twelve (12) mounting formations 44. Thus, it can be said that in some embodiments the drain body 4 can have at least eight (8) mounting formations 44 or various other quantities of mounting formations 44.

In yet other embodiments, the inner diameter D1 of at least one and up to all of the receptacles 46 can be less than ⅜ inch or greater than ⅜ inch. Moreover, the major diameter D2 of the internal threads 56 of the inserts 54 can be less than ⅜ inch or greater than ⅜ inch. In additional embodiments, all of the receptacles 46 can be configured to receive rebar guide members 48, or all of the receptacles 46 can include inserts 54 for receiving threaded-rod guide members 48, or some of the receptacles 46 can be configured to receive rebar guide members 48 while some of the receptacles 46 are configured to receive threaded-rod guide members 48. In further embodiments, at least one and up to all of the receptacles 46 can have non-circular cross-sectional shapes. In yet further embodiments, one or more of the mounting formations 44 can have an outer surface geometry that differs from that of the illustrated embodiment. In yet other embodiments, at least some of the mounting formations 44 can be unevenly spaced about the central axis 10. In yet additional embodiments, the drain body 4 can be devoid of mounting formations 44. It should be understood that various other adaptations can be made to the mounting formations 44 while remaining within the scope of the present disclosure.

Figure 3A:
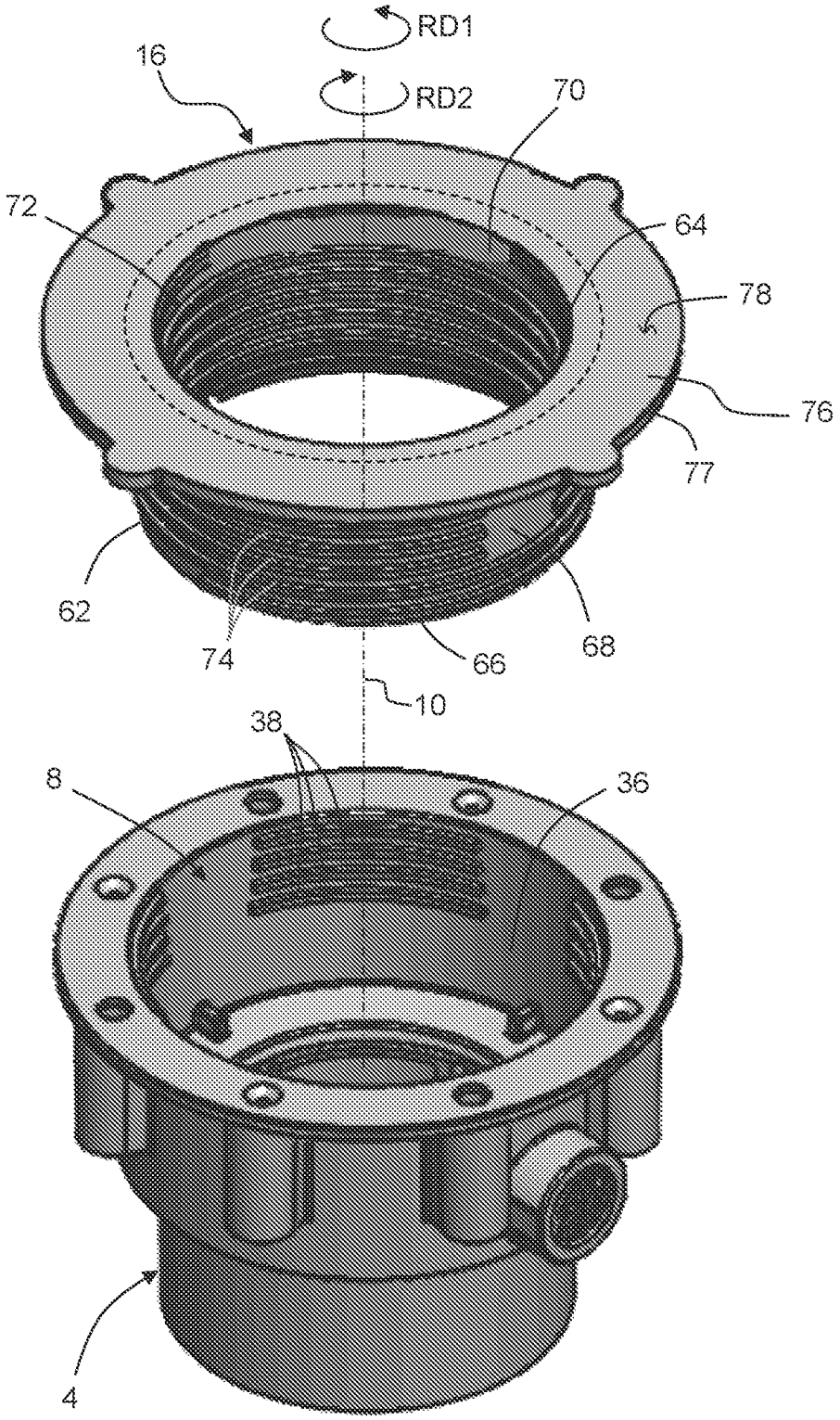
FIG. 3A is an exploded perspective view of the drain body and adjustable upper barrel shown in FIG. 1.

Referring now to FIG. 3A, the upper barrel 16 has a central body 62 that has a top end 64 and an opposed bottom end 66 axially spaced from each other. In the illustrated embodiment, the top and bottom ends 64, 66 of the central body 62 also define top and bottom ends, respectively, of the upper barrel 16. In other embodiments, one or both of the top end 64 and the bottom end 66 of the central body 62 need not define the respective top or bottom end of the upper barrel 16. The central body 62 has an exterior barrel surface 68 radially opposite an interior barrel surface 70 that defines a barrel channel 72. The barrel channel 72 extends axially from the top end 64 to the bottom end 66 of the central body 62. The central body 62 is insertable within the upper receptacle portion 36 of the drain body 4 such that the barrel channel 72 is alignable along the central axis 10. In this manner, the barrel channel 72 is also alignable with the drain channel 8 when the central body 62 is inserted within the upper receptacle portion 36.

The exterior threads 74 of the upper barrel 16 are formed on the exterior barrel surface 68 of the central body 62 adjacent to the bottom end 66 thereof. The interior barrel surface 70 of the central body 62 has interior threads 75 formed thereon. The exterior threads 74 of the central body 62 are engageable with the interior threads 38 of the drain body 4 such that the upper barrel 16 is axially adjustable relative to the drain body 4 along the central axis 10. In particular, the exterior threads 74 of the upper barrel 16 and the interior threads 38 of the drain body 4 are configured such that: rotating the upper barrel 16 in a first rotational direction RD1 about the central axis 10 causes the upper barrel 16 to translate upward relative to the drain body 4; and rotating the upper barrel 16 in a second rotational direction RD2 opposite the first rotational direction RD1 about the central axis 10 causes the upper barrel 16 to translate downward relative to the drain body 4. In the illustrated embodiment, the first rotational direction RD1 is counterclockwise and the second rotational direction RD2 is clockwise. In other embodiments, the first rotational direction RD1 can be clockwise and the second rotational direction RD2 can be counterclockwise.

Figure 3C:
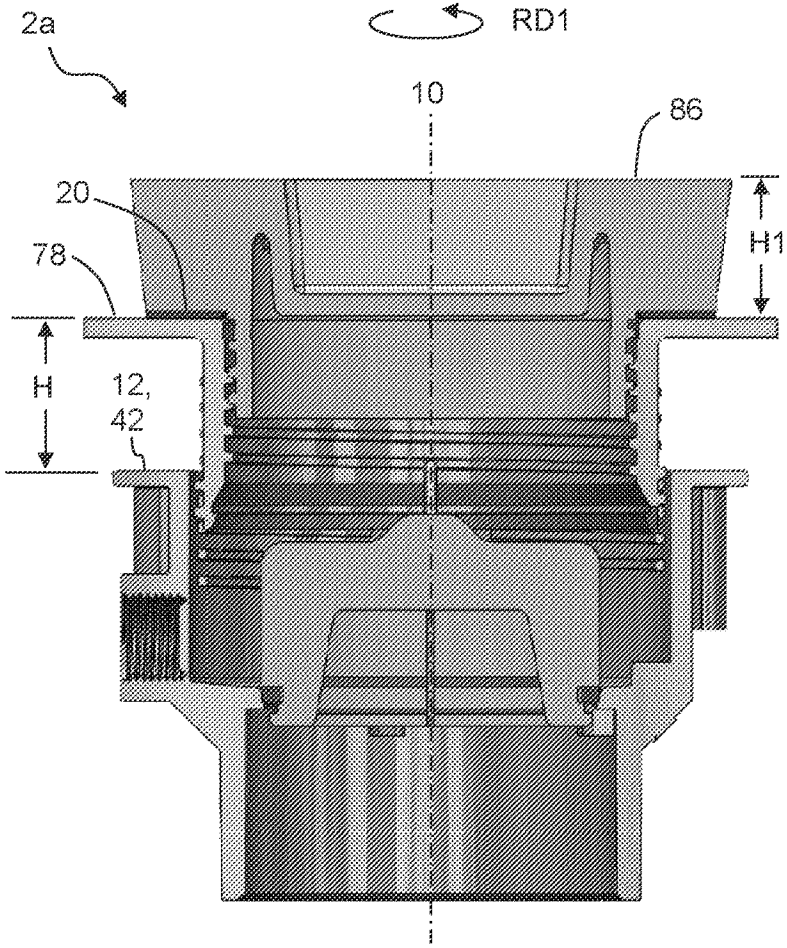
FIGS. 3B and 3C are sectional side views of the pre-pour sub-assembly shown in FIG. 1, illustrating the adjustable upper barrel at a minimum elevation (FIG. 3A) and a maximum elevation (FIG. 3B) relative to the drain body.
Figure 3B:
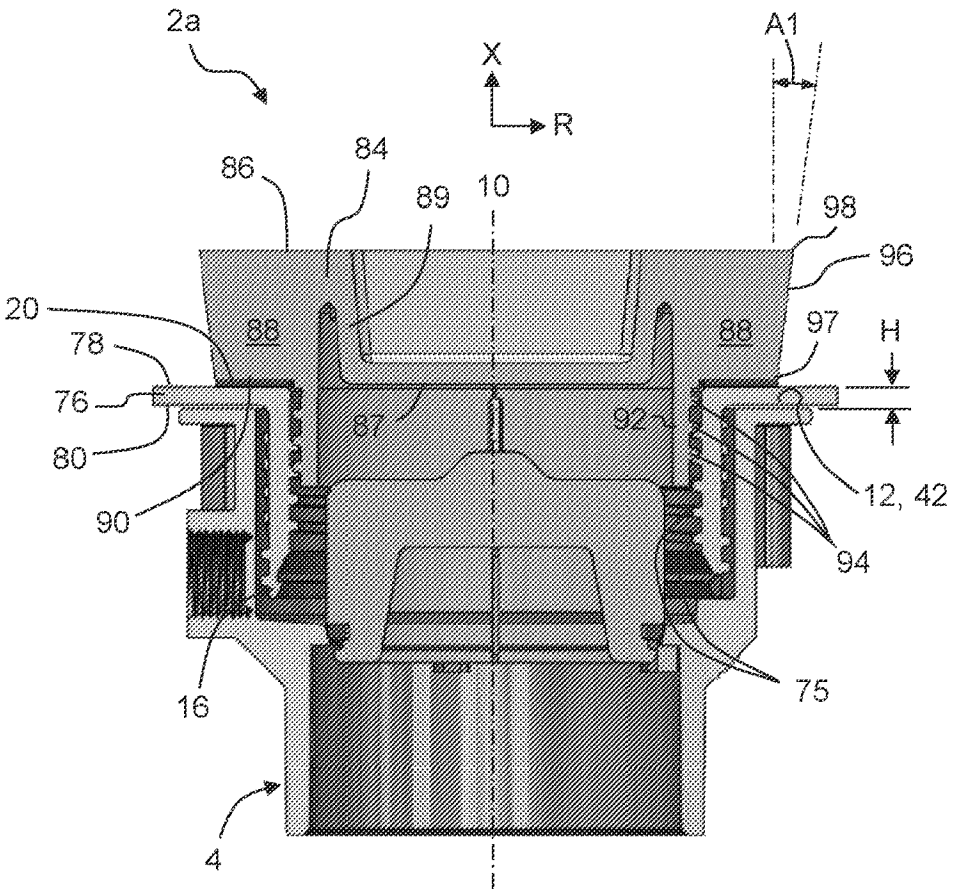

Referring now to FIGS. 3A-3C, the upper barrel 16 includes a barrel flange 76 extending radially outward from the top end 64 of the central body 62 to an outer circumferential edge 77. The barrel flange 76 defines a landing surface 78 that faces away from the bottom end 66 of the upper barrel 16. The barrel flange 76 also defines a bottom surface 80 axially opposite the landing surface 78. When the upper barrel 16 is connected to the drain body 4, the landing surface 78 of the upper barrel 16 is spaced apart from the top end 12 of the drain body 4 by a first distance H. Axially adjusting the upper barrel 16 relative to the drain body 4 adjusts the distance H by which the landing surface 78 extends above the top end 12 of the drain body 4. This distance H can be adjusted as needed based on the desired depth at which the cement is to be poured with respect to the pre-pour drain sub-assembly 2*a*, as described in more detail below. As shown in FIG. 3B, the upper barrel 16 is axially adjustable such that, at a minimum of the distance H (i.e, when the upper barrel 16 is fully seated with respect to the drain body 4), the bottom surface 80 of the barrel flange 76 substantially abuts the upper surface 42 of the drain flange 40. In other embodiments, an axial gap is present between the bottom surface 80 of the barrel flange 76 and the upper surface 42 of the drain flange 40 when the upper barrel 16 is fully seated with respect to the drain body 4.

In the illustrated embodiment, the barrel flange 76 includes a plurality of protrusions 82 (which can also be referred to as "tabs") extending radially outward from the circumferential edge 77, as shown in FIG. 3A. The protrusions 82 are configured to reside within cement poured about the drain assembly 2 to resist rotation of the upper barrel 16 about the central axis 10, such as after the cement hardens. In the illustrated embodiment, the barrel flange 76 has four (4) protrusions 82, which have rounded, semi-circular outer edges and are evenly spaced at 90-degree intervals about the central axis 10. In other embodiments, the barrel flange 76 can have one (1), two (2), three (3), five (5), six (6), seven (7), eight (8), nine (9), ten (10), or more than ten (10) protrusions 82. Thus, it can be said that, in some embodiments, the barrel flange 76 can have at least four (4) protrusions 82 or various other quantities of protrusions 82. In addition embodiments, at least some of the protrusions 82 can be unevenly spaced about central axis 10. In further embodiments, one or more of the protrusions 82 can have other outer edge geometries, including liner outer edge geometries. In yet other embodiments, the barrel flange 76 can be devoid of protrusions 82.

With continued reference to FIGS. 3B-3C, the cap plug 18 includes a top wall 84 and an outer body 88 and an inner body 89 connected by the top wall 84. The top wall 84 has a top surface 86. The inner body 89 of the cap plug 18 has a bottom surface 87 opposite the top surface 86. The inner body 89 defines at least one receptacle 91 that extends from the top surface 86 toward the bottom surface 87 and is configured for receiving a tool configured to remove the cap plug 18 from the upper barrel 16. In the illustrated embodiment, the top surface 86 of the cap plug 18 defines the uppermost end of the pre-pour sub-assembly 2*a* when assembled. The outer body 88 and the inner body 89 of the cap plug 18 each extend axially downward from the top wall 84. The outer body 88 defines a stop surface 90 that faces downward toward the landing surface 78 of the barrel flange 76 when the cap plug 18 is connected to the upper barrel 16. The plug gasket 20 is axially receivable between, and abuttable with, the stop surface 90 and the landing surface 78 to provide a seal therebetween, thereby occluding the top end 64 of the barrel channel 72.

The outer body 88 of the cap plug 18 includes an inner portion 92 that extends axially below the stop surface 90 and is insertable within the barrel channel 72. The inner portion 92 has external threads 94 that are removably engageable with the interior threads 75 of the upper barrel 16, such that the cap plug 18 is removably attachable to the upper barrel 16 during a pre-pour phase of drain installation. In this manner, the cap plug 18 is configured to threadedly couple with the interior threads 75 of the upper barrel 16 to lower the stop surface 90 and bring the plug gasket 20 into sealing contact with the stop surface 90 and the landing surface 78, thereby sealing the barrel channel 72. The cement can then be poured around the pre-pour sub-assembly 2*a*, including around the cap plug 18, which can remain attached to the upper barrel 16 after the cement fully hardens. Subsequently, during the post-pour phase, the cap plug 18 and plug gasket 20 are removed and the post-pour sub-assembly 2*b* is attached to the upper barrel 16.

The outer body 88 of the cap plug 18 defines an exterior plug surface 96 that is engageable with cement during a cement pouring phase of drain installation. The exterior plug surface 96 extends from a lower edge 97 at an interface with the stop surface 90 to an upper edge 98 at an interface with the top surface 86. In the illustrated embodiment, the exterior plug surface 96 is angled outwardly from the lower edge 97 to the upper edge 98 at a taper angle A1 of about 9 degrees from an axis parallel with the central axis 10. In other embodiments, the taper angle A1 can be in a range from 0 degrees to about 15 degrees. In further embodiments, the taper angle A1 can be greater than 15 degrees, such as up to about 35 degrees.

The cap plug 18 is preferably constructed of a material that inhibits binding with the cement. In this manner, the cap plug 18 provides a substantially non-binding contact interface between the exterior plug surface 96 and the cement, such that the exterior plug surface 96 remains substantially removably connected to the cement after the cement hardens. A non-limiting example of one such material is acetal plastic (i.e., polyoxymethylene). Additional non-limiting examples of such materials include polytetrafluoroethylene (PTFE), acetal homopolymer, and acetal copolymer. The inventors have tested numerous cap plug 18 configurations and have observed that, when constructed from acetal plastic, the cap plug 18 described herein can be unthreaded axially upward and removed from fully hardened cement that had been poured around the sub-assembly 2*a* and up to the upper edge 98 of the exterior plug surface 96 (or above the upper edge 98, though this requires removing (e.g., chiseling) the hardened cement over the top surface 86 of the cap plug 18 prior to removing the cap plug 18). In yet other embodiments, the exterior plug surface 96 can be coated with a layer of coating material configured to inhibit binding with the cement at the plug-cement contact interface. Such coating materials can include polyvinyl alcohol, mineral oil, silicone, polysiloxane, wax, and polytetrafluoroethylene (PTFE), by way of non-limiting examples.

The top surface 86 of the cap plug 18 defines the uppermost end of the assembled pre-pour sub-assembly 2*a*. In one operative configuration of the drain assembly 2, the cap plug 18 is fully seated within the barrel channel 72, such that the top surface 86 of the cap plug 18 is spaced upwardly from the barrel landing surface 78 at a cap elevation distance H1 along the axial direction X.

It should be understood that the axial adjustability of distance H (by rotating the upper barrel 16 relative to the drain body 4 in the first rotational direction RD1) is important for providing pre-pour adjustments to distance H1 based on the desired depth of the cement pour. This adjustability allows a single pre-pour sub-assembly to be used for a wider range of cement depths, which significantly simplifies the drain selection process for users and also provides users with increased installation tolerances (such as for the height of the top end of the drain pipe 35). The axial adjustability of distance H also reduces the need for producing different drain bodies or assemblies having different set distances H, thereby providing significant cost savings for manufacturing. Additionally, the threaded engagement between the interior threads 38 of the drain body 4 and the exterior threads 74 of the upper barrel 16 provides fine control of the adjustments to distance H while maintaining sturdy, reliable attachment of the upper barrel 16 to the drain body 4.

Figure 4B:
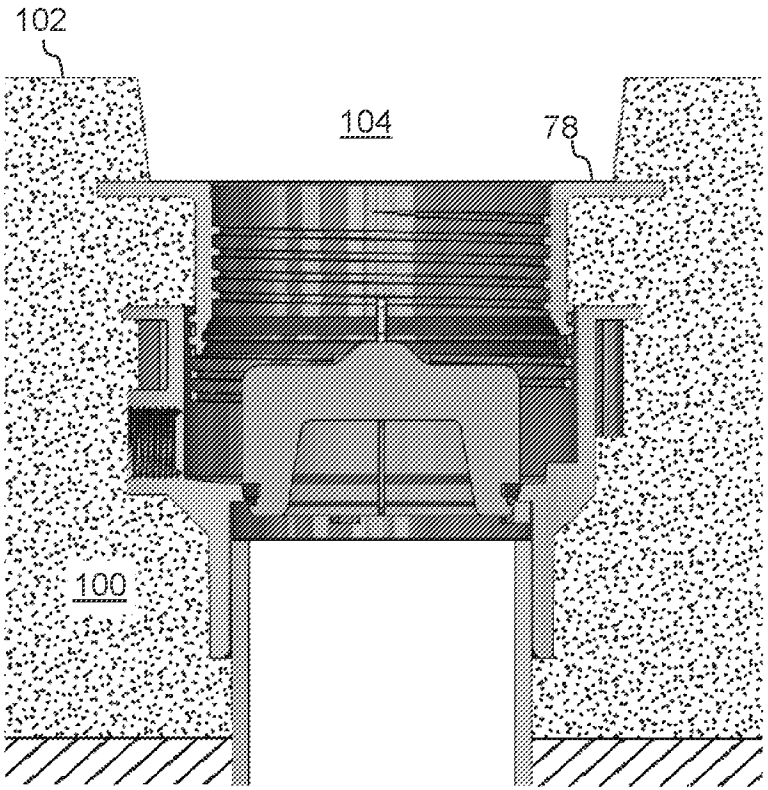
FIGS. 4A and 4B are sectional side views of the pre-pour sub-assembly of FIGS. 2A-2B, shown at intermediate phases of a drain installation.
Figure 4A:
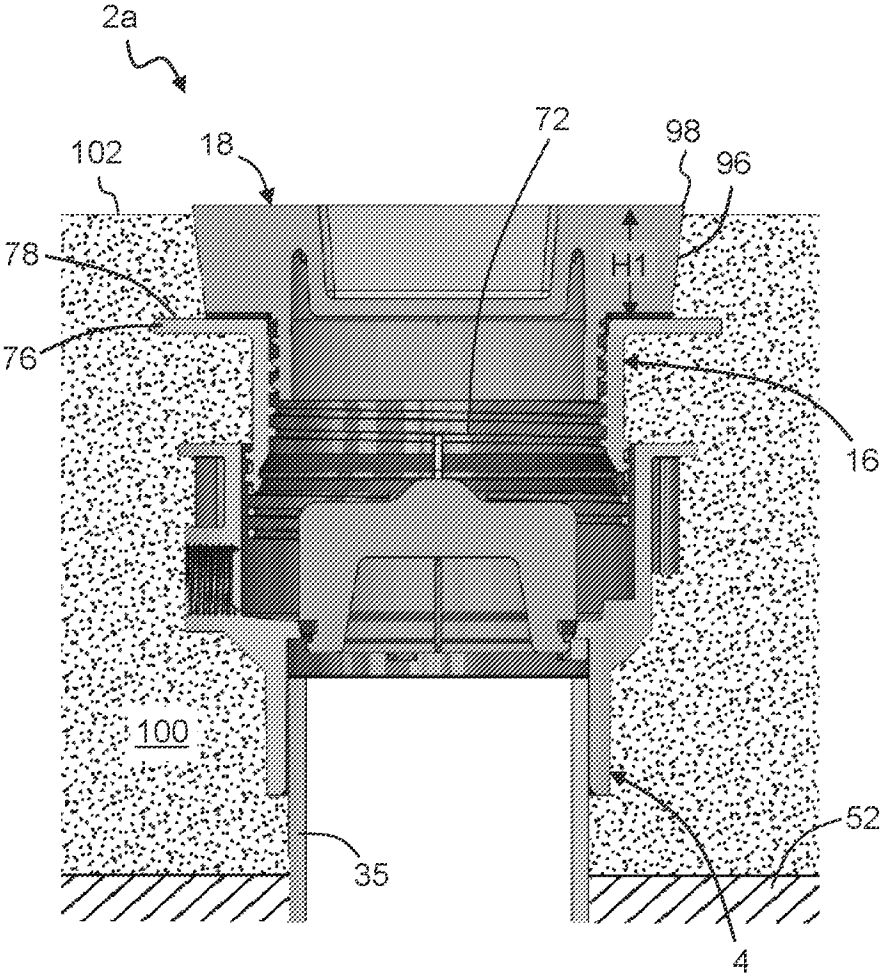

Referring now to FIGS. 4A-4B, with the adjustable pre-pour distance H set at the desired height, and the cap plug 18 fully seated within the barrel channel 72, the cement pouring phase can commence. In the cement pouring phase, cement 100 is poured over the substrate layer 52 and around the pre-pour sub-assembly 2*a*, including around the exterior plug surface 96 of the cap plug 18. Preferably, the cement 100 is poured to a final height such that a top surface 102 of the cement 100 is substantially level with, or slightly below, the upper edge 98 of the exterior plug surface 96. The top surface 102 of the poured, wet cement 100 can be leveled and the cement 100 is allowed to harden, thereby rigidly fixing the position of the drain body 4 and the upper barrel 16.

As shown in FIG. 4B, after the cement 100 hardens, the cap plug 18 is unthreaded and removed from the upper barrel 16, leaving in its place a void 104 in the cement 100 having a geometry and volume substantially equivalent to that of the exterior plug surface 96. With the cap plug 18 removed, the drain assembly 2 is ready to receive the post-pour sub-assembly 2*b*. The protrusions 82 of the barrel flange 76 are enclosed by the concrete to prevent unwanted rotation of the upper barrel 16 while the cap plug 18 is being unthreaded from the interior threads 75 of the barrel channel 72. Although FIG. 4A shows the top surface 102 of the poured cement 100 being slightly recessed from the top surface 86 of the cap plug 18, it should be understood that the pre-pour sub-assembly 2*a* can accommodate instances where the cement 100 is poured to a depth such that the cement 100 extends over the top surface 86 of the cap plug 18. In such instances, after the cement has hardened, the user can chisel out or otherwise remove the cement 100 over the top surface 86 of the cap plug 18 and subsequently remove the cap plug 18.

Referring now to FIGS. 5A-5C, and as mentioned above, the post-pour sub-assembly 2*b* includes a strainer barrel 26, a support ring 34, and a grate 32. The strainer barrel 26 includes a central strainer body 110, which is insertable within the barrel channel 72 of the upper barrel 16. The central strainer body 110 has an exterior surface 112 radially opposite an interior surface 114. The interior surface 114 defines a strainer barrel channel 116 alignable with the central axis 10. The exterior surface 112 of the central strainer body 110 has exterior threads 118 that are engageable with the interior threads 75 of the upper barrel 16 such that the strainer barrel 26 is axially adjustable relative to the upper barrel 16.

The strainer barrel 26 includes a support flange 150 that extends radially outward from the central strainer body 110. The support flange 150 has an upper landing surface 152 and an opposed bottom flange surface 153, which is abuttable with the landing surface 78 of the barrel flange 76 of the upper barrel 16. The strainer barrel 26 also includes an outer body 154 that extends axially upward from the support flange 150 to the top end 28 of the strainer barrel 26. The outer body 154 has an interior surface 156 that, together with the upper landing surface 152, defines an interior strainer receptacle 158 sized to receive a grate 32. The strainer barrel 26 has a plurality of mounting posts 160 that extend axially upward from the upper landing surface 152 and radially inward from the interior surface 156 of the outer body 154. The mounting posts 160 define screw holes 162 for attaching the grate 32 to the strainer barrel 26.

In the illustrated embodiment, the grate 32 is circular and is insertable within the interior strainer receptacle 158. In other embodiments, the shape of the outer body 154 and the grate 32 can be square, rectangular, oval, or any other shape while still having a cylindrical central strainer body 110 for connecting to the upper barrel 16. The grate 32 has an upper surface 120, an opposed lower surface 122, and a plurality of weep apertures 124 extending axially from the upper surface 120 to the lower surface 122. In the illustrated embodiment, the lower surface 122 of the grate 32 has a convex profile (see FIG. 5C). In other embodiments, the lower surface 122 can have other profiles, including planar or concave. Referring again to the illustrated embodiment, the grate 32 has a peripheral band 125 that defines an exterior circumferential surface 126 that extends between the upper and lower surfaces 120, 122. The grate 32 includes a plurality of grate mounting tabs 127 that extend radially inward from the peripheral band 125. The grate mounting tabs 127 define respective screw holes 128 extending axially from the upper surface 120 to the lower surface 122.

In the illustrated embodiment, the grate 32 is removably attachable to the support ring 34, which is removably attachable to the strainer barrel 26 for interconnecting the grate 32 to the top end 28 of the strainer barrel 26. The support ring 34 defines an exterior ring surface 130 and an interior ring surface 132 radially opposite the exterior ring surface 130. The support ring 34 includes an interior lip 134 formed on the interior ring surface 132, which defines a seat for supporting the peripheral band 125 of the grate 32. The support ring 34 includes a first plurality of mounting tabs 136 extending radially inward from the interior lip 134. The first plurality of mounting tabs 136 define respective screw holes 138 that extend axially therethrough and are alignable with the screw holes 128 of the grate 32. The post-pour sub-assembly 2*b* includes a first plurality of screws 140 that are insertable through the screw holes 128 of the grate 32 and into the screw holes 138 of the first plurality of mounting tabs 136 of the support ring 34.

The support ring 34 includes a second plurality of mounting tabs 142 extending radially inward from the interior lip 134. The second plurality of mounting tabs 142 define respective screw holes 144 that extend axially therethrough. The second plurality of mounting tabs 142 are alignable with the mounting posts 160 in the interior strainer receptacle 158, as described in more detail below. As shown in FIG. 5A, the first and second pluralities of mounting tabs 136, 142 are disposed in alternating fashion about the central axis 10. The post-pour sub-assembly 2*b* includes a second plurality of screws 146 that are insertable through the screw holes 144 of the second plurality of mounting tabs 142 and into the respective screw holes 162 of the mounting posts 160 in the interior strainer receptacle 158. As shown in FIG. 5C, the peripheral band 125 of the support ring 34 is mountable atop the top end 28 of the outer body 154 of the strainer barrel 26, thereby elevating the grate 32 above the upper landing surface 152 so as to accommodate the convex profile of the lower surface 122 of the grate 32. When the grate 32, the support ring 34, the strainer barrel 26 are assembled together, the top surface 120 of the grate 32 extends upward from the bottom flange surface 153 of the support flange 150 of the strainer barrel 26 at a grate elevation distance H2 that is less than the cap elevation distance H1.

It should be understood that the post-pour sub-assembly 2*b* can be fully assembled before coupling with the upper barrel 16 or can be assembled in stages such that at least one of the stages is performed after inserting the central strainer body 110 within the barrel channel 72. In additional embodiments, the post-pour sub-assembly 2*b* can include a cleanout cover that is devoid of weep apertures 124 and is interchangeable with the grate 32 for adapting the drain assembly 2 into a cleanout drain configuration.

Figure 6B:
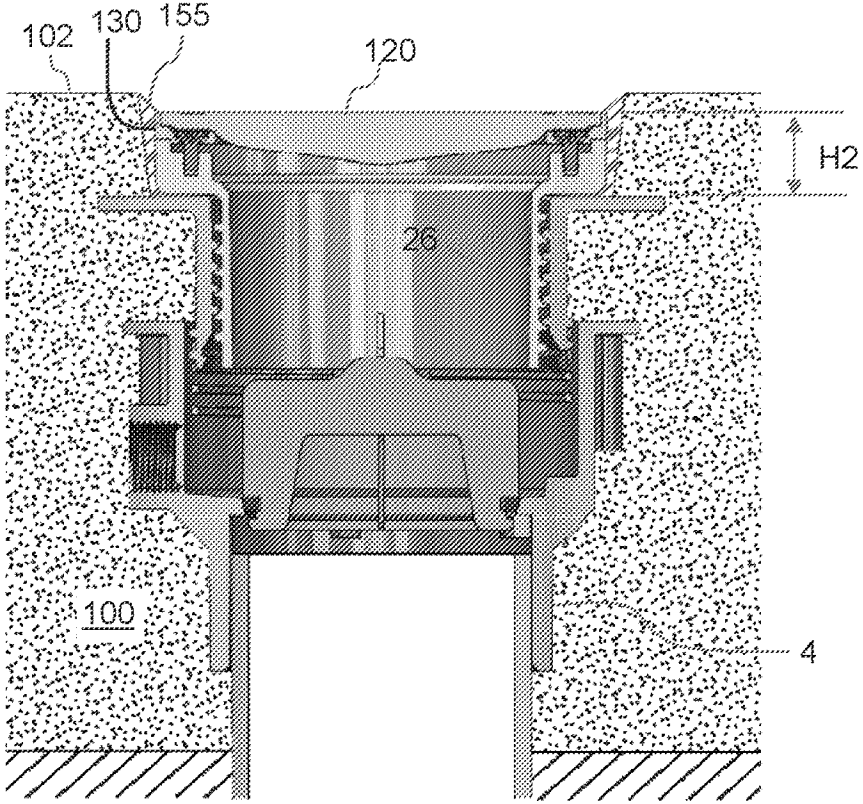
FIGS. 6A and 6B are sectional side views of the drain assembly in a second operative configuration, in which the post-pour sub-assembly is coupled to the upper barrel of the pre-pour sub-assembly and is axially adjustable therewith.
Figure 6A:
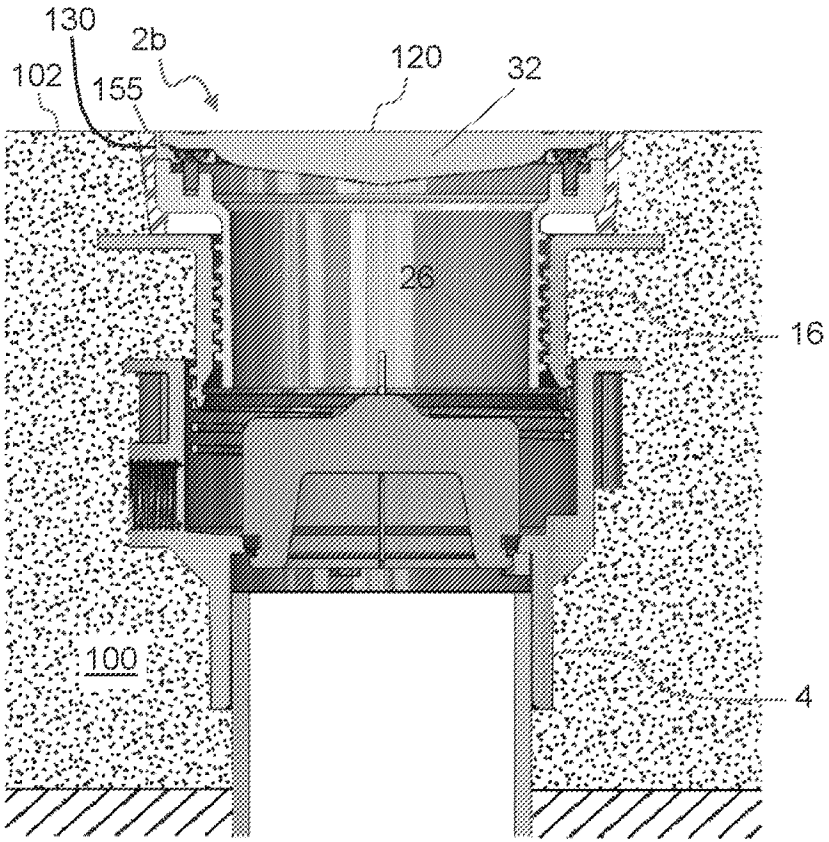

Referring now to FIGS. 6A-6B, with the cap plug 18 removed, the post-pour sub-assembly 2*b* can be coupled to the upper barrel 16 to complete the drain assembly 2. The central strainer body 110 of the strainer barrel 26 is insertable through the void 104 and into the barrel channel 72 to engage the exterior threads 118 of the central strainer body 110 with the interior threads 75 of the upper barrel 16. These exterior and interior threads 118, 75 provide the strainer barrel 26 with axially adjustability relative to the upper barrel 16, as described above. This provides another operative configuration of the drain assembly 2, particularly in which the strainer barrel 26 is axially adjustable relative to the upper barrel 16 while the barrel landing surface 78 has a fixed position relative to the drain body 4. By rotatably adjusting the strainer barrel 26 relative to the upper barrel 16, the top surface 120 of the grate 32 can be aligned with the top surface 102 of the cement (FIG. 6A) and even recessed downward from the top surface 102 of the cement 100 (FIG. 6B), if necessary or desired. After the axial position of the strainer barrel 26 is set relative to the upper barrel 16, the gap(s) between the post-pour sub-assembly 2*b* and the cement 100 in the void are filled with a filler material 155, such a grout, caulk, silicone, or other filler materials. If the top surface 120 of the grate 32 is recessed from the top surface 102 of the cement 100, the filler material 155 should be employed to slope downwardly from the cement 100 to the grate 32 to prevent drainage fluid from accumulating between the exterior ring surface 130 of the support ring 34 and the cement 100.

The ability to axially adjust the top surface 120 of the grate 32 downward relative to the top surface 102 of the cement 100 is referred to herein as "negative adjustability," and it provides significant advantages over prior art drain assemblies. For example, the cap 18 provides a void having a sufficient height above the landing surface 78 of the upper barrel 16 to allow the post-pour sub-assembly 2*b* to be axially adjusted relative to the upper barrel 16 to ensure proper alignment of the top surface 120 of the grate 32 to be substantially aligned with the top surface 102 of the concrete 100, even when the top surface 102 of the finished concrete 100 does not align with the top surface 86 of the cap plug 18 before the cap plug 18 is removed and replaced with the post-pour sub assembly 2*b*. Further, if desired or needed, the negative adjustability allows the top surface 120 of the grate to be adjusted to a position below the top surface of the cement, as shown in FIG. 6B, thereby providing a slight detent or lowered area within the cement 100 to allow water or other liquids to flow down into the drain assembly 2. Such negative adjustability can avoid costly drain re-installations that might otherwise be required by a faulty cement pour or other issues arising during a drain installation. For example, one issue that tends to arise involves a floor construction that includes a plurality of drain assemblies 2. Depending upon the sloping requirements of the floor and other factors, one or more of the pre-pour sub-assemblies 2*a* might be set too high, resulting in the top surface 86 of a cap plug 18 residing above the top surface 102 of the poured cement 100. In such instances, drain assemblies without negative adjustability might protrude above the top surface 102 of the cement 100, often requiring users to replace any such drain assembly by chipping out the cement, re-setting the drain assembly, and then repouring the cement around the drain assembly.

Figure 7B:
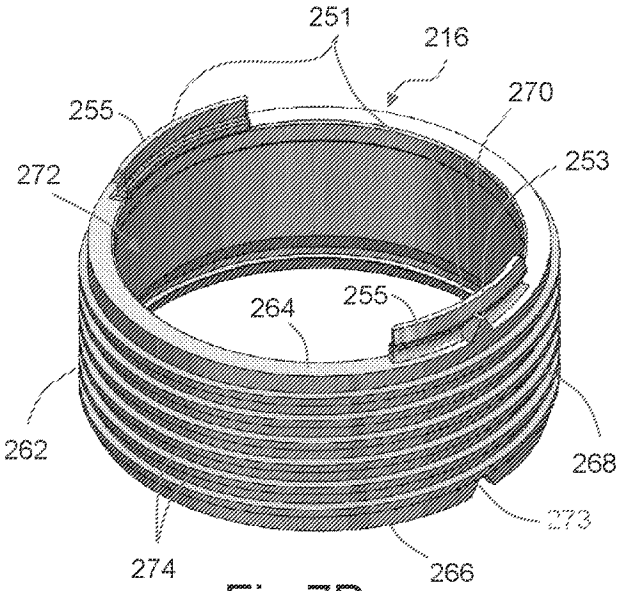
FIG. 7B is a perspective view of the extender barrel shown in FIG. 7A.
Figure 7C:
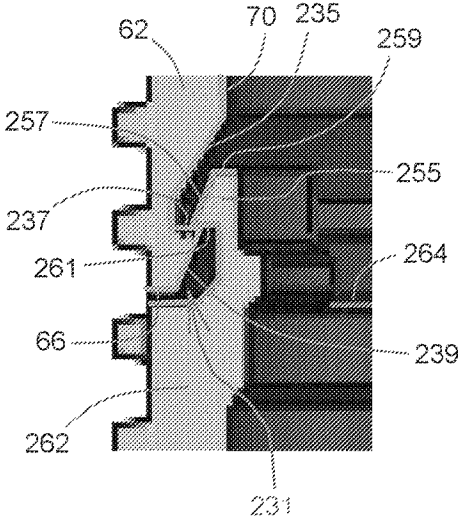
FIG. 7C is an enlarged view of a region of FIG. 7A, showing interconnected attachment mechanisms of the upper barrel and extender barrel shown.
Figure 7A:
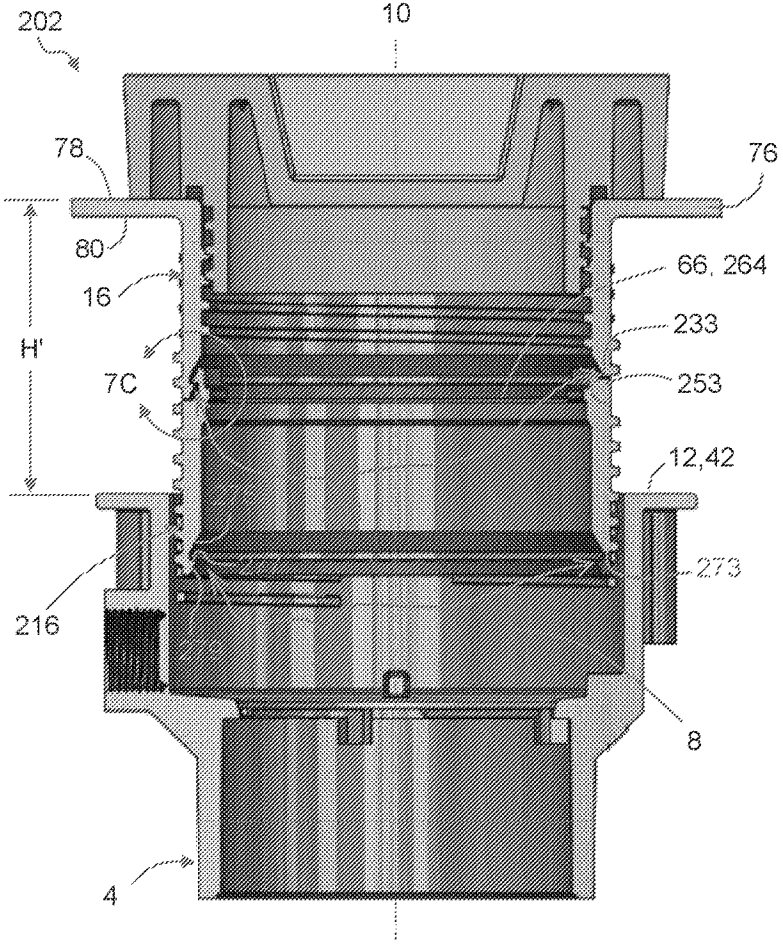
FIG. 7A is a sectional side view of an exemplary embodiment of a drain assembly having an extender barrel interconnecting an upper barrel with a drain body, shown in a first operative configuration.

Referring now to FIGS. 7A-7C, in another embodiment, a drain assembly 202 is adapted to provide an increased distance H' by which the flange landing surface 78 extends above the top surface 12 of the drain body 4. Accordingly, the drain assembly 202 of the present embodiment can be referred to as an "extendable drain assembly" 202. It should be understood that components of the drain assemblies 2, 202 that are common to, or substantially similar in, both assemblies 2, 202 have the same reference characters. It should also be understood that the primary difference between the drain assemblies 2, 202 is that the extendable drain assembly 202 includes an extender barrel 216 that is attachable to the bottom end 66 of the upper barrel 16 for providing the increased distance H'.

As shown in FIG. 7A, the upper barrel 16 is attachable to the extender barrel 216, which is also axially adjustable relative to the drain body 4. The extender barrel 216 has an extender body 262. The extender body 262 has a top end 264 and an axially opposed bottom end 266. The extender body 262 also defines an exterior barrel surface 268 and a radially opposed interior barrel surface 270. The interior barrel surface 270 defines an extender barrel channel 272 that is alignable with the upper barrel channel 72 and with the drain channel 8. The exterior barrel surface 268 has external threads 274 that are engageable with the interior threads 38 of the drain body 4 for axially adjusting the relative position of the extender barrel 216 relative to the drain body 4. The upper barrel 16 is couplable to the extender barrel 216, and the bottom end 266 of the extender barrel 216 is insertable within the drain channel 8 and threadedly coupled therewith. Accordingly, the extendable drain assembly 202 provides increased flexibility for accommodating various types of drain installation. In particular, a user can elect to install the drain assembly 202 using the upper barrel 16 without the extender barrel 216. Thus, in a first operative orientation of this embodiment, the bottom end 66 of the upper barrel 16 is insertable within the drain channel 8 for threadedly coupling therewith. Alternatively, in a second operative orientation of this embodiment, the bottom end 66 of the upper barrel is attachable to the top end 266 of the extender barrel 216, and the bottom end 266 thereof is insertable within the drain channel 8 for threadedly coupling therewith. The extender barrel 16 is configured to increase the distance between the upper surface 42 of the drain body 8 and the bottom surface 80 of the flange 76 of the upper barrel 16. The increased distance provided by the extender barrel 216 allows for the drain assembly 2 to be located within a floor having a larger thickness or depth.

In particular, the bottom end 66 of the upper barrel 16 defines a first attachment mechanism 231. The top end 264 of the extender body 262 defines a second attachment mechanism 251 releasably attachable to the first attachment mechanism 231 of the upper barrel 16. The first attachment mechanism 231 includes a first recess 233 extending axially upward into the central body 62 at the bottom end 66 thereof. The second attachment mechanism 251 includes a first protrusion 253 extending axially upward from the top end 264 of the extender body 262. The first protrusion 253 is receivable within the first recess 233 in the second operative orientation. For illustrative purposes, it should be understood that the first recess 233 of the first attachment mechanism 231 is substantially to the recess 273 shown at the bottom end 266 of the extender body 262 in FIG. 7B, which recess 273 is described in more detail below.

As best shown in FIG. 7C, the first attachment mechanism 231 also includes a second recess 235 extending radially outward into the central body 62 from the interior barrel surface 70 thereof. In the illustrated embodiment, the second recess 235 is radially opposite the first recess 233. The central body 62 defines additional features of the first attachment mechanism 231, including a bottom stop surface 237 at a bottom end of the second recess 235 and a first angled surface 239 extending upwardly between the bottom end 66 of the central body 62 and the bottom stop surface 237.

The second attachment mechanism 251 comprises a second protrusion 255 that extends upwardly from the top end 264 extender body 262 and is engageable with the second recess 235 in the second operative orientation. The second protrusion 255 defines a second angled surface 257 extending downwardly from a top end 259 of the second protrusion, the second angled surface 257 engageable with the first angled surface 235 of the first attachment mechanism 251. The second protrusion 255 also defines a latch surface 261 below the second angled surface 257. The second protrusion 255 is flexible radially inward from an unlatched orientation, during engagement between the first and second angled surfaces 239, 257, and subsequently biased radially outward into a latched orientation, shown in FIG. 7C, in which the latch surface 261 overlays the bottom stop surface 237, thereby impeding axial detachment of the upper barrel 16 and the extender barrel 216.

The extender barrel 216 of the illustrated embodiment has a stackable geometry. In particular, in a third operative orientation of this embodiment, the bottom end 266 of the extender body 262 is attachable to a top end 264 of a third barrel 216 that has the same geometry as the extender barrel 216, and which is therefore insertable within the drain channel 8 for threadedly coupling thereto to axially adjust distance H'. Additionally, in the illustrated embodiment, the bottom end 266 of the extender barrel 216 has a third attachment mechanism 271 that has substantially the same geometry as the first attachment mechanism 231 of the upper barrel 16. For example, the third attachment mechanism 271 includes a third recess 273 (FIG. 7B), which has the same geometry as the first recess 233 at the bottom end 66 of the upper barrel 16. As shown in FIG. 7B, the third recess 273 has an inverted V-shaped profile. As shown in FIG. 7A, the third attachment mechanism 271 also includes a fourth recess 275 that is located opposite the third recess 273 and has the same geometry as the second recess 235 at the bottom end 66 of the upper barrel 16 (FIG. 7C). The third attachment mechanism 271 includes a bottom stop surface 277 at a bottom end of the fourth recess 275 and a third angled surface 279 extending upwardly between the bottom end 266 of the extender body 262 and the bottom stop surface 277. The bottom stop surface 277 and the third angled surface 279 have the same respective geometries as the bottom stop surface 237 and the first angled surface 239 of the first attachment mechanism 231 of the upper barrel 16. Because the geometries of the third attachment mechanism 271 are the same as the geometries of the first attachment mechanism 231, the extender barrel 216 is stackable atop an additional extender barrel 216. Thus, the extendable drain assembly 202 of the illustrated embodiment can include virtually any quantity of extender barrels 216, which can be stacked one on top of another and coupled together to progressively increase the adjustable distance between the flange landing surface 78 of the upper barrel 16 and the top end 12 of the drain body 4.

In other embodiments, the extendable drain assembly 202 can include an upper barrel 16 and a plurality of stackable extender barrels 216, such that at least one of the extender barrels 216 has a different geometry (e.g., a different axial length) than at least one other extender barrel 216. It should be understood that extendable drain assemblies 202 can include stackable extender barrels 216 having various geometries to accommodate various drain installations.

With reference to FIGS. 8A-8C and FIGS. 9A-9C, example embodiments of drain assemblies 302, 402 having modular drain bodies 304, 404 will be described. It should be understood that the components of these drain assemblies 302, 402 that are the same or substantially similar to those employed in the drain assemblies 2, 202 described above will utilize the same reference characters. It should also be understood that, for the sake of conciseness, the following description will focus on differences between the present drain assemblies 302, 304 and the drain assemblies 2, 202 described above. These modular drain bodies 304, 404 each employ the drain body 4 described above as a base drain body that is attachable with one or more specialized components that allow the base drain body 4 to be used in various specialized drain installations, such as in a cored opening drain installation, a waterproofing drain installation, or various other types of drain installations. Typically for such drain installation types, a single-piece flanged drain body is employed, in which the flange member is monolithic with the drain body. On a commercial scale, this requires increased production and inventory costs to manufacture and distribute the various types of single-piece flanged drain bodies. The present embodiments reduce such costs by providing modular adaptation of a base drain body 4.

Figure 8A:
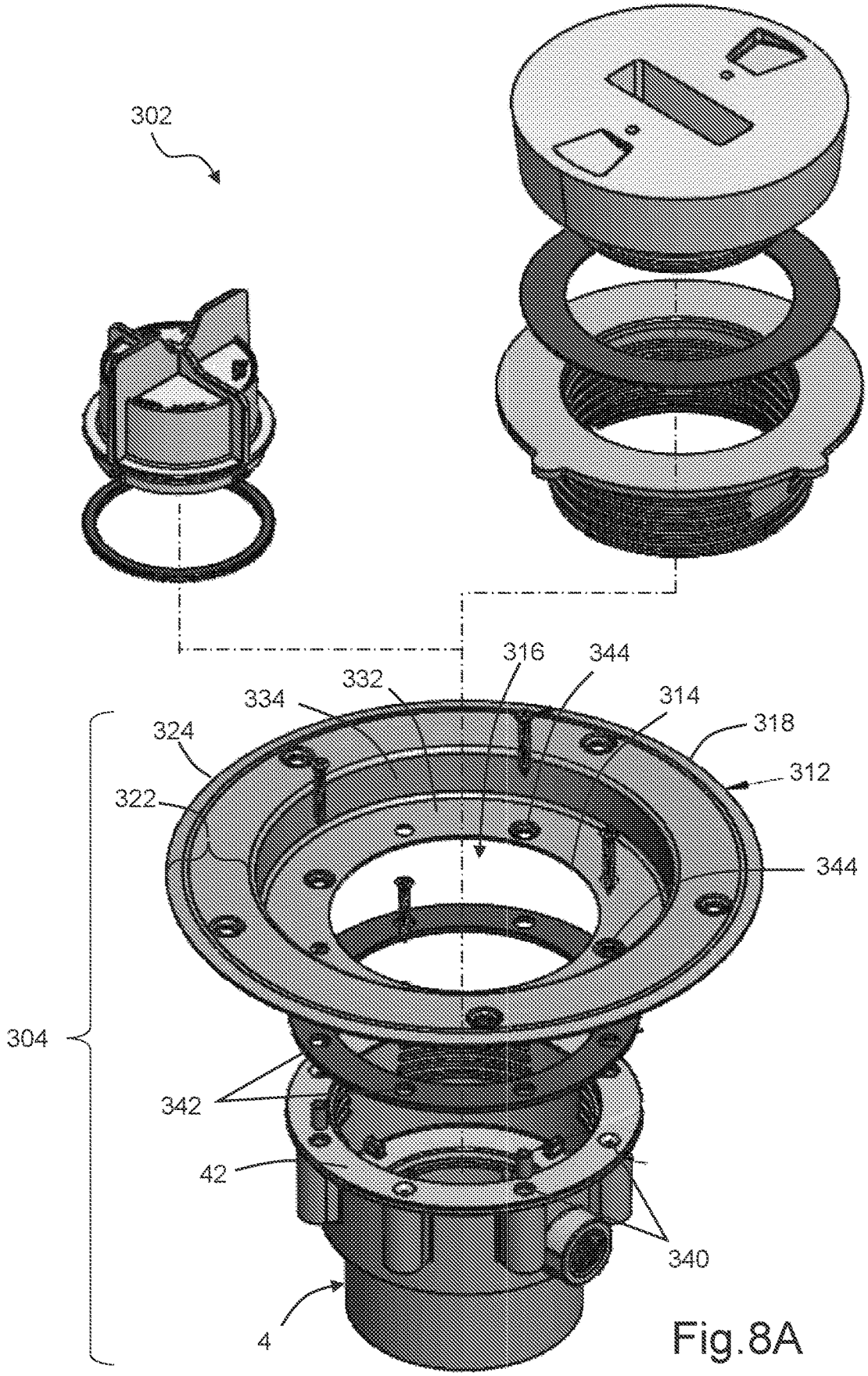
FIG. 8A is an exploded perspective view of an exemplary embodiment of a drain assembly having a deck flange, shown in a first operative configuration.
Figure 8B:
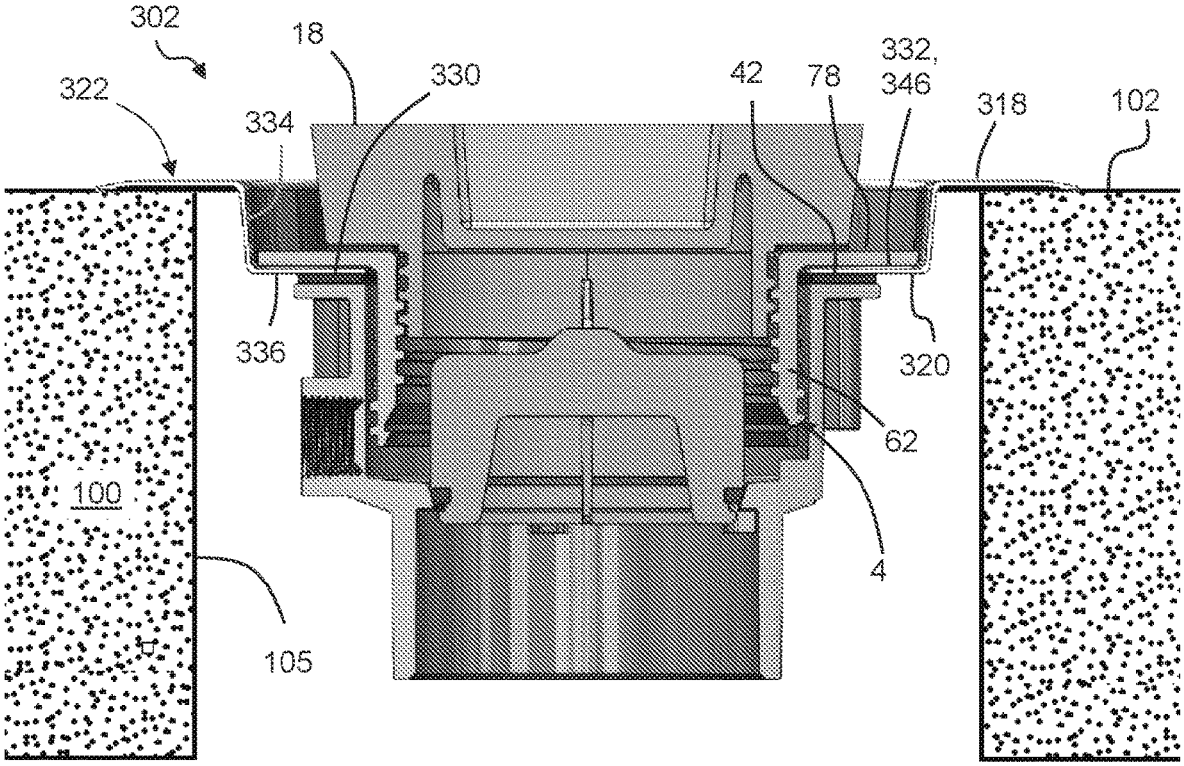
FIG. 8B is a sectional side view of the drain assembly of FIG. 8A, shown in a cored opening type of drain installation.
Figure 8C:
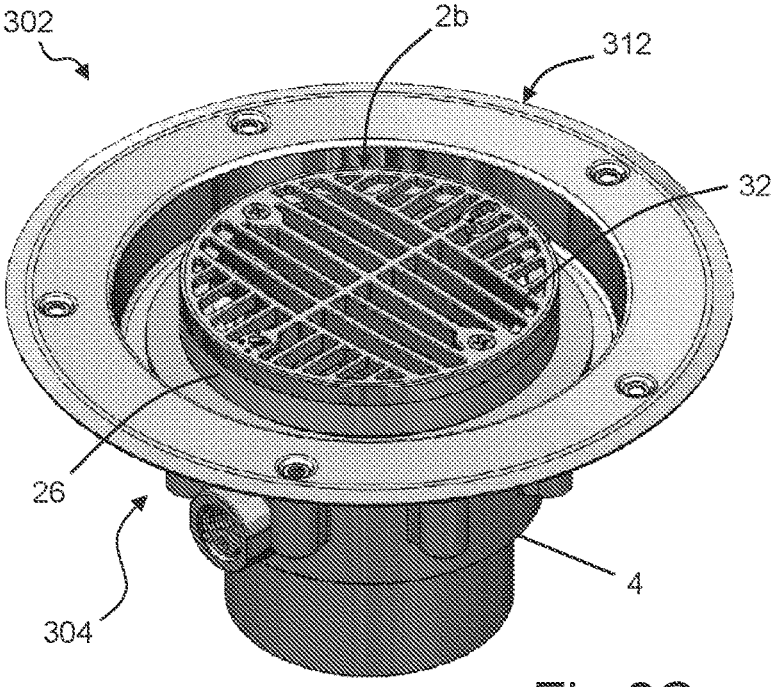
FIG. 8C is a perspective view of the drain assembly of FIG. 8A shown in a second operative configuration.

Referring now to FIGS. 8A-8C, a modular deck drain body 304 will now be described. The modular deck drain body 304 includes the base drain body 4 having a deck flange body 312 attachable therewith. The modular deck drain body 304 is particularly suited for use in a cored opening type of drain installation, in which the flange body 312 can be used to suspend the modular drain body 304 over the opening during the pre-pour phase, as shown in FIG. 8B. Although FIG. 8B depicts such a cored opening 105 formed in cement 100, it should be understood that the modular deck drain body 304 can be employed in cored openings formed in other construction materials, such as wood decking, metal corrugate, and the like.

The flange body 312 is attachable to the upper mounting surface 42 of the base drain body 4. The flange body 312 has an interior circumferential edge 314 that defines a flange channel 316, which is alignable with the central axis 10. The flange body 312 has a top end 318 and a bottom end 320 axially opposite the top end 318. The flange body 312 includes a flange member 322 that has an outer circumferential edge 324 spaced radially outward from the interior circumferential edge 314. The interior drain surface 6 of the base drain body 4 and the interior circumferential edge 314 of the flange body 312 are respectively sized for receiving therein the central body 62 of the upper barrel 16 while the flange body 302 is attached to the upper mounting surface 42 of the base drain body 4.

The flange body 312 includes a lower mounting portion 332 at the bottom end 320 and a tubular riser portion 334 extending axially upwardly from the lower mounting portion 332. The flange member 322 extends radially outward from the tubular riser portion 334 to the outer circumferential edge 324. The lower mounting portion 332 has a lower mounting surface 336 configured to face the upper mounting surface 42 of the base drain body 4. A flange gasket 330 is retainable between the upper and lower mounting surfaces 42, 336 for providing a seal therebetween.

The upper mounting surface 42 of the base drain body 4 defines a first plurality of screw holes 340, the flange gasket 330 defines a second plurality of holes 342, and the lower mounting portion 332 of the flange body 312 defines a third plurality of holes 344. At least some of each of the first, second, and third pluralities of holes 340, 342, 344 are axially alignable with each other. A plurality of screws 346 insertable through the axially alignable holes of the first, second, and third pluralities of holes 340, 342, 344 for affixing the flange body 312 and the flange gasket 330 to the upper mounting surface 42 of the base drain body 4.

In the illustrated embodiment, the central body 62 of the upper barrel 16 is insertable through the flange channel 316 and the flange gasket 330 and into the upper receptacle portion 36 of the drain channel 8 to threadedly engage the interior threads 38 therein. The upper barrel 16 is axially adjustable relative to the base drain body 4 in similar fashion to that described above. In this embodiment, however, the bottom surface 80 of the barrel flange 76 is abuttable against an upper surface 346 of the lower mounting portion 332 of the flange body 312. With reference to FIGS. 8B and 8C, the cap plug 18 is interchangeable with the post-pour subassembly 2*b* in the same manner as described above. It should be understood that the strainer barrel 26 provides the grate 32 with negative adjustability in similar fashion to that described above. It should also be understood that the upper barrel 16 of the illustrated embodiment can be adapted for use with one or more extender barrels 216 in the manner described above.

Figure 9A:
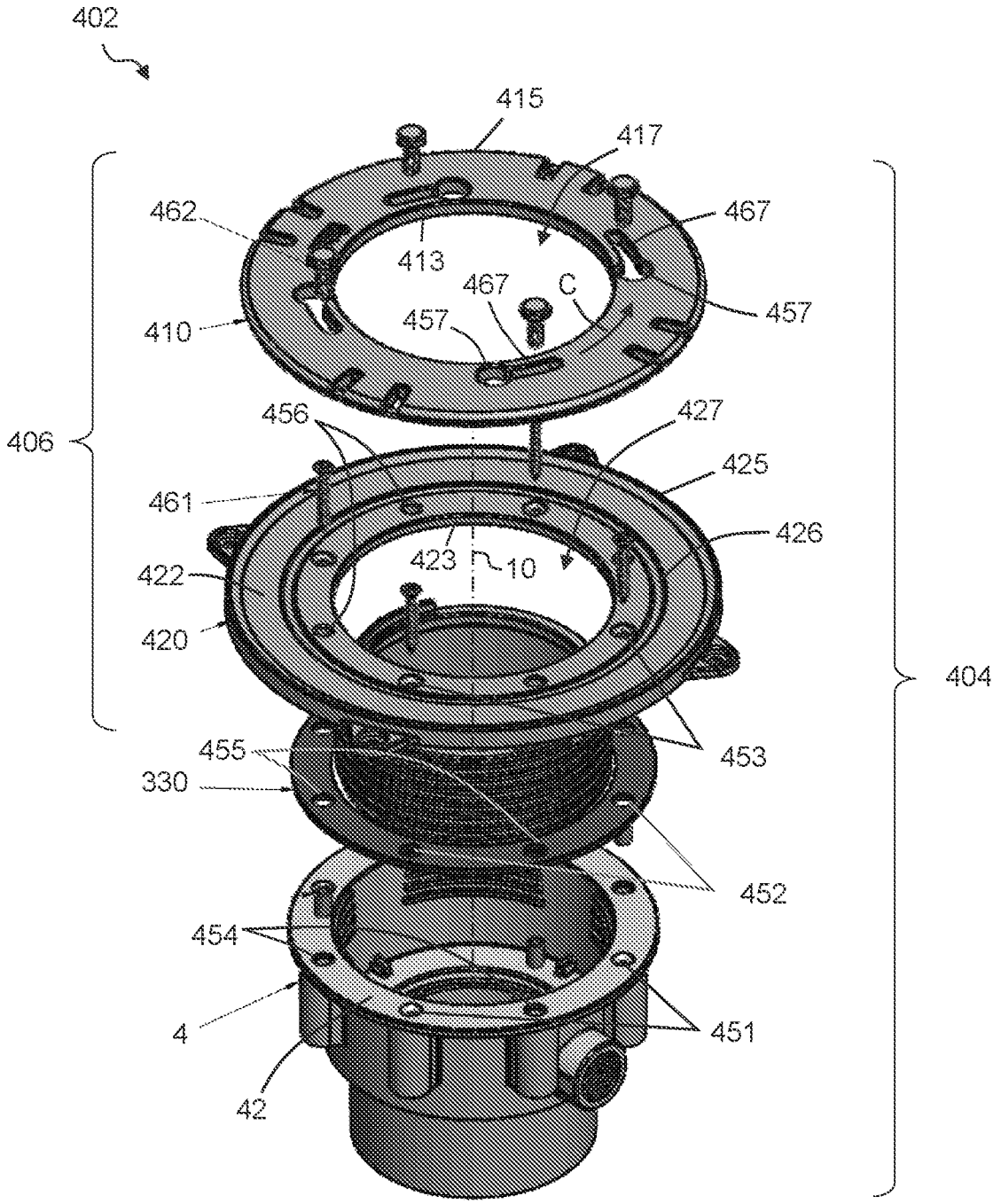
FIG. 9A is an exploded perspective view of an exemplary embodiment of a drain assembly having a waterproofing flange.
Figure 9B:
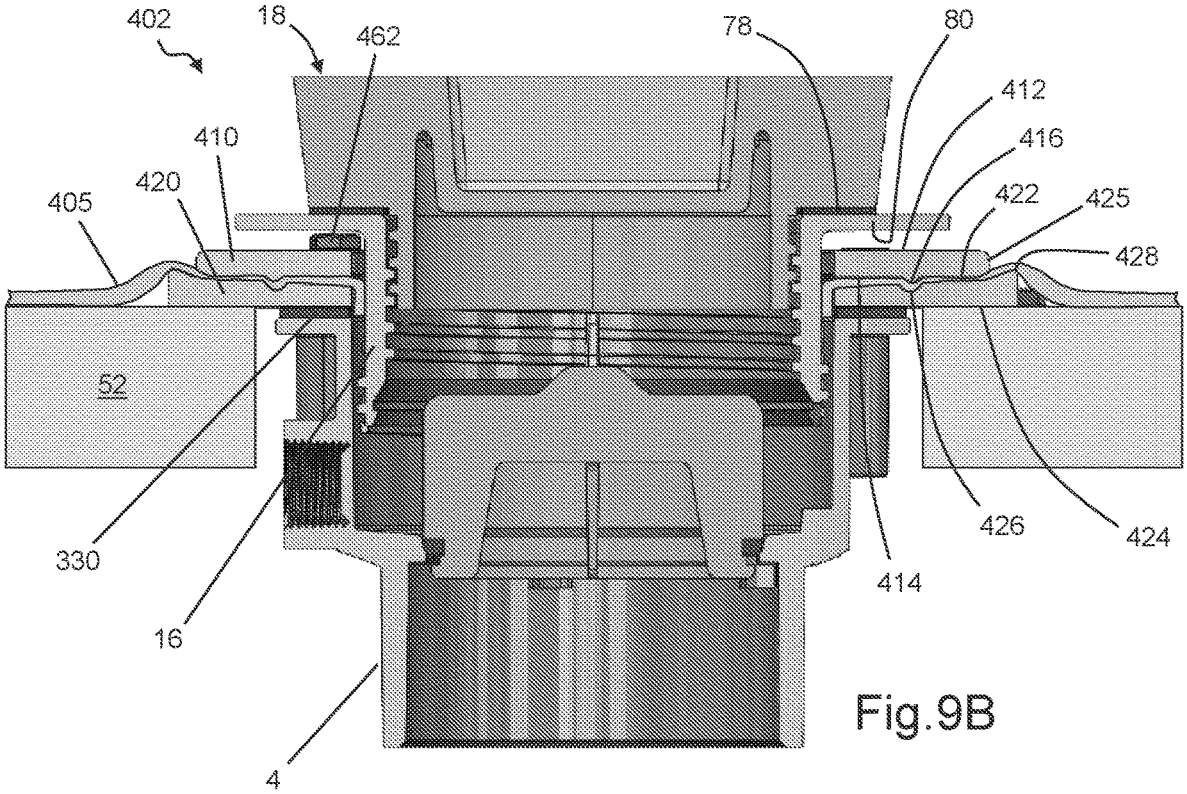
FIG. 9B is a sectional side view of the drain assembly of FIG. 9A, shown in a first operative configuration of a waterproofing type of drain installation.

Referring now to FIGS. 9A-9B, a modular waterproofing drain body 404 will now be described. The modular waterproofing drain body 404 includes the base drain body 4 having a waterproofing flange body 410 and a clamping collar body 420 attachable therewith. The modular waterproofing drain body 404 is particularly suited for use in a waterproofing drain installation that employs a waterproof membrane 405.

The flange body 410 has a top surface 412 and an axially opposed bottom surface 414. The flange body 410 extends radially outward from an interior circumferential surface 413 to an exterior circumferential surface 415. The interior circumferential surface 413 defines a flange channel 417 that is axially alignable with the drain channel 8.

The collar body 420 is axially receivable between the flange body 410 and a flange gasket 330. The collar body 420 has an upper collar surface 422 and an axially opposed lower collar surface 424. The collar body 420 extends radially outward from an interior circumferential surface 423 to an exterior circumferential surface 425. The interior circumferential surface 423 defines a collar channel 427 that is axially alignable with the drain channel 8 and the flange channel 417.

In the illustrated embodiment, the flange body 410 and the collar body 420 together form a clamp mechanism 406 for clamping the waterproof membrane 405 in sealing fashion with the base drain body 4. As best shown in FIG. 9B, the bottom surface 414 of the flange body 410 has an annular protrusion 416 formed thereon that is receivable within an annular groove 426 that is downwardly recessed from the upper collar surface 422. The annular protrusion 416 and the annular groove 426 have complimentary geometries for pinching the waterproof membrane 405 therebetween in sealing fashion. In the illustrated embodiment, the collar body 420 also includes an axially raised lip 428 adjacent to the outer circumferential surface 425 of the collar body 420. When the modular drain body 404 is in an assembled operative configuration, the axially raised lip 428 is adjacent to the outer circumferential surface 415 of the flange body 410, thereby providing a secondary clamping interface for clamping the waterproof membrane 405.

It should be understood that the upper collar surface 422 is abuttable with the bottom surface 412 of the flange body 410, such as in the absence of the waterproof membrane 405. The lower collar surface 424 is abuttable with an upper surface of the flange gasket 330. A lower surface of the flange gasket 330 is abuttable with the upper mounting surface 42 of the base drain body 4 for providing a seal between the collar body 420 and the base drain body 4.

In the illustrated embodiment, the upper mounting surface 42 of the base drain body 4 defines a first plurality of holes 440. The flange gasket 330 defines a second plurality of holes 442. The collar body 420 defines a third plurality of holes 444. At least some of each of the first, second, and third pluralities of holes 440, 442, 444 are axially alignable with each other. A first plurality of screws 461 are insertable, respectively, through the axially aligned holes of the first, second, and third pluralities of holes 451, 452, 453 for attaching the collar body 420 and the flange gasket 330 to the base drain body 4.

With continued reference to the illustrated embodiment, the upper mounting surface 42 also defines a fourth plurality of holes 454 that are separate from the first plurality of holes 451. The flange gasket 330 also defines a fifth plurality of holes 455 that are separate from the second plurality of holes 452. The collar body 420 also defines a sixth plurality of holes 456 that are separate from the third plurality of holes 453. The flange body 410 defines a seventh plurality of holes 457. A second plurality of screws 462 are insertable, respectively, at least through the axially aligned holes of the sixth and seventh pluralities of holes 456, 457 for clamping the flange body 410 toward the collar body 420. In this manner, when the waterproof membrane 405 is disposed axially between the collar body 420 and the flange body 410, the second plurality of screws 462 facilitate actuation of the clamping mechanism 406.

In the illustrated embodiment, the seventh plurality of holes 457 in the flange body 410 are contiguous with respective turn slots 467 that extend away from the holes 457 in a circumferential direction C. The associated holes 457, turn slots 467, and screws 462 are cooperatively configured so that the second plurality of screws 462 are insertable within the sixth plurality of holes 456 in the collar body 420, with the respective screw shafts extending upwardly therefrom. The flange body 410 can be axially lowered over the screws 462 such that the respective screw heads pass through the seventh plurality of holes 547 until the lower ends of the heads reside above the top flange surface 412. From this position, the flange body 410 is partially rotated about the central axis 10 to guide the screw shafts into the turn slots 467. This partial rotation causes the screw heads to drive the flange body downward toward the collar body, clamping the waterproof membrane 405 therebetween.

Figure 9C:
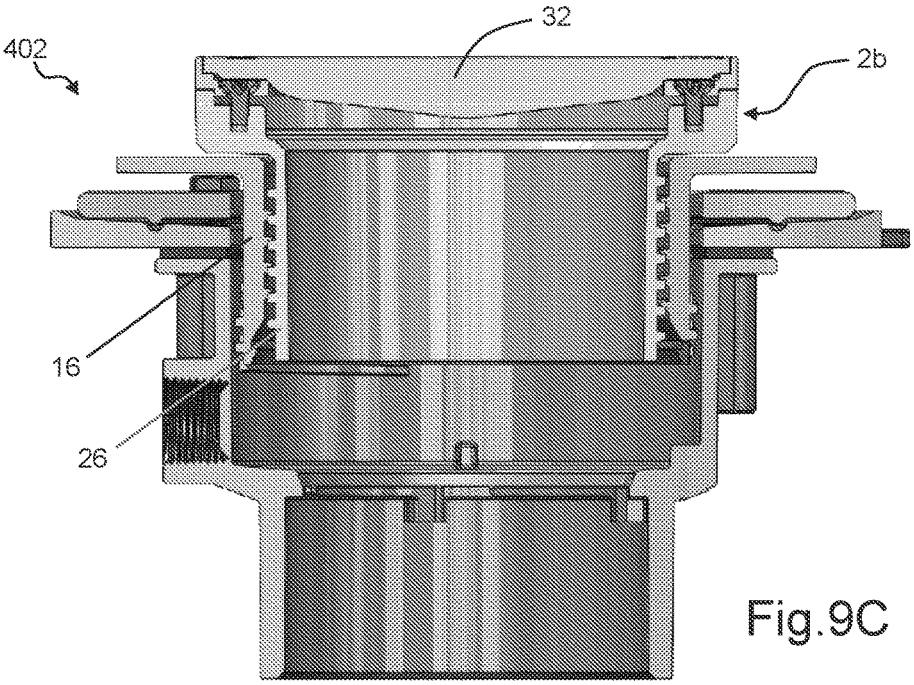
FIG. 9C is a sectional side view of the drain assembly of FIG. 9A, shown in a second operative configuration.

With reference to FIGS. 9B and 9C, the cap plug 18 is interchangeable with the post-pour sub-assembly 2*b* in the same manner as described above with references to the other drain assemblies 2, 202, 302. It should be understood that the strainer barrel 26 provides the grate 32 with negative adjustability relative to the modular drain body 404 in similar fashion to that described above. It should also be understood that the upper barrel 16 of the illustrated embodiment can be adapted for use with one or more extender barrels 216 in the manner described above.

It should be understood that other embodiments of the modular deck drain bodies 304 and modular waterproofing drain bodies 404 can employ different screw and hole configurations than those described above for coupling the respective components together.

Referring now to FIGS. 10A-10F, the test plug 22 shown in FIG. 1 will be described in more detail. It should be understood that each of the drain assemblies 2, 202, 302, 402 in the illustrated embodiments herein include the test plug 22, which is insertable within the drain channel 8 for releasably sealing the drain channel 8. In particular, the test plug 22 is releasably attachable to a plug seat 165 within the drain channel 8 to provide a seal between the upper receptacle portion 36 and the lower portion 39 of the drain channel 8. The test plug 22 is sealable to the plug seat 165 with sufficient force to facilitate pressure testing of the drain system connected to the bottom end 14 of the drain body 4. It should be understood that the test plug 22 can also effectively function as a cleanout plug that can be removed from the drain channel 8 to provide access to a cleaning instruments, such as a drain snake.

Figure 10A:
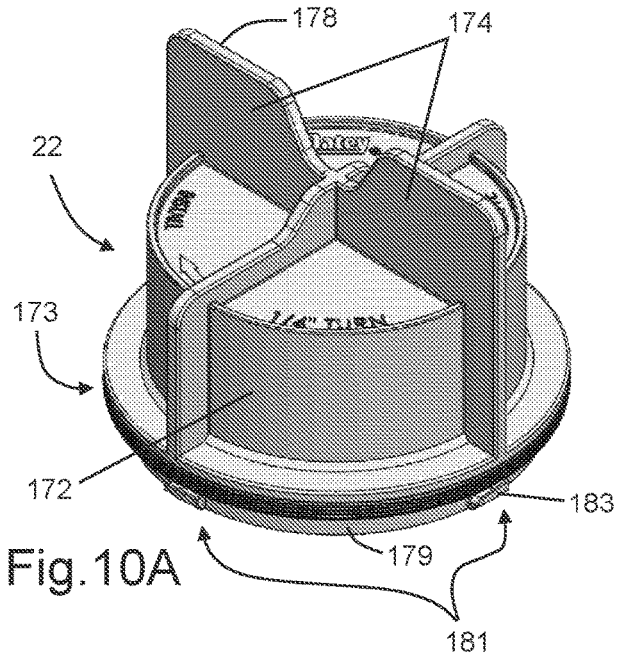
FIG. 10A is a perspective view of a test cap of the drain assemblies herein.

Referring now to FIG. 10A, the test plug 22 has a plug body 170 having an exterior surface 172 and at least one tab 174 extending away from the exterior surface 172. The at least one tab 174 is configured to be gripped for assisting a user rotate the tab 174 about the central axis 10 to couple and/or de-couple the test plug from the interior surface 6 of the drain body 4. In the illustrated embodiment, the plug body 170 has four (4) tabs 174. As shown in FIG. 10C, a first pair of the tabs 174 extend upwardly to a first plug height H3 measured axially from a bottom end 176 of the plug body 170 to a top end 178 of the first pair of tabs 174. A second pair of the tabs 174 extend upward to a second plug height that is less than the first plug height H3. It should be understood that the first plug height H3 is less than an axial distance H4 measured from the bottom end 176 of the plug body 170 to the bottom surface 87 of the top wall 84 of the cap plug 18 when the test plug 22 is affixed to the plug seat 165.

Figure 10B:
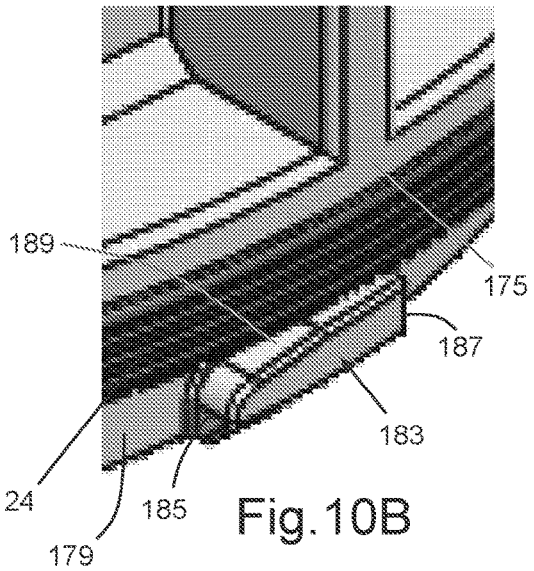
FIG. 10B is an enlarged view of a portion of a locking mechanism of the test cap shown in FIG. 10A.
Figure 10C:
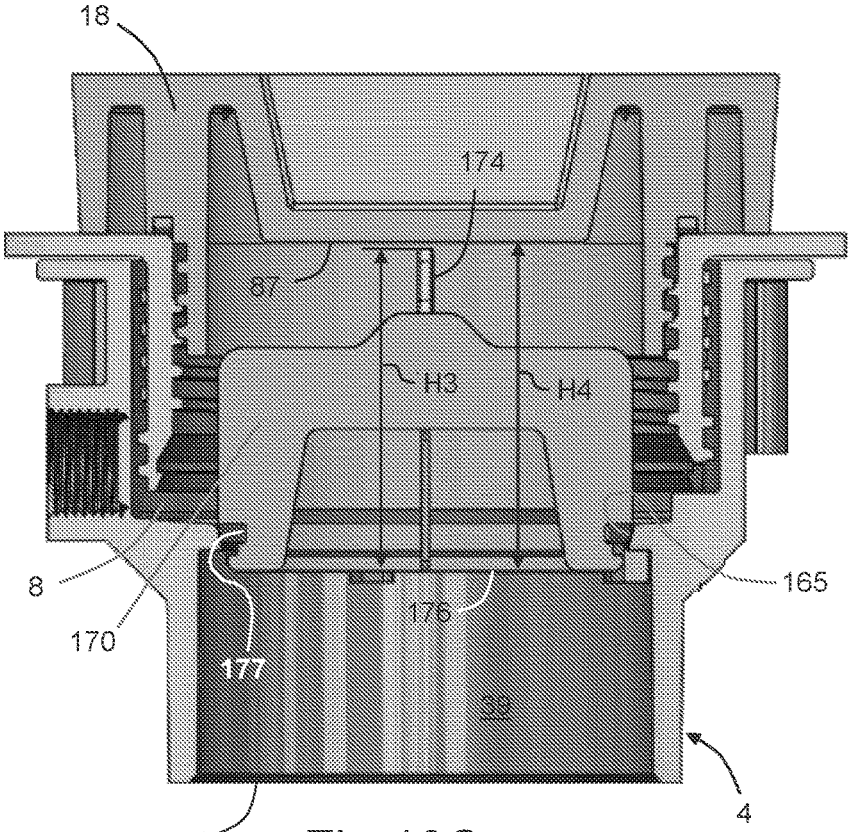
FIG. 10C is a sectional side view of the first operative drain assembly of FIG. 1, showing the test cap seated against a plug seat within a drain channel of a drain body, according to an exemplary embodiment of the present disclosure.

Referring now to FIGS. 10B-10C, the plug body 170 has a bottom portion 173 having an outer wall 175 and an annular gasket receptacle 177 extending radially inward from the outer wall 175. The plug gasket 24 is received within the annular gasket receptacle 177. The bottom portion 173 of the plug body 170 has a cylindrical exterior surface 179 located axially below the annular gasket receptacle 177. The plug body 170 has a locking mechanism 181 extending radially outward from the cylindrical exterior surface 179 for releasably attaching the plug gasket 24 to the plug seat 165.

Figure 10D:
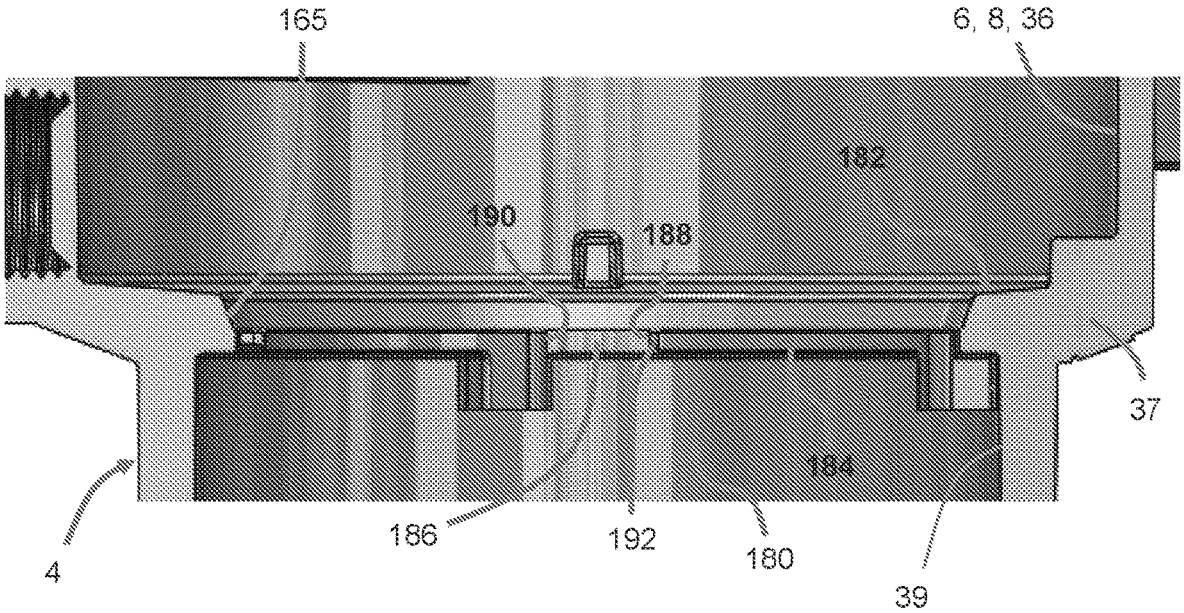
FIG. 10D is a sectional side view of a portion of the drain body shown in FIG. 10C, illustrating a locking mechanism of the drain body adjacent the plug seat for releasable attachment with the locking mechanism of the test plug.
Figure 10E:
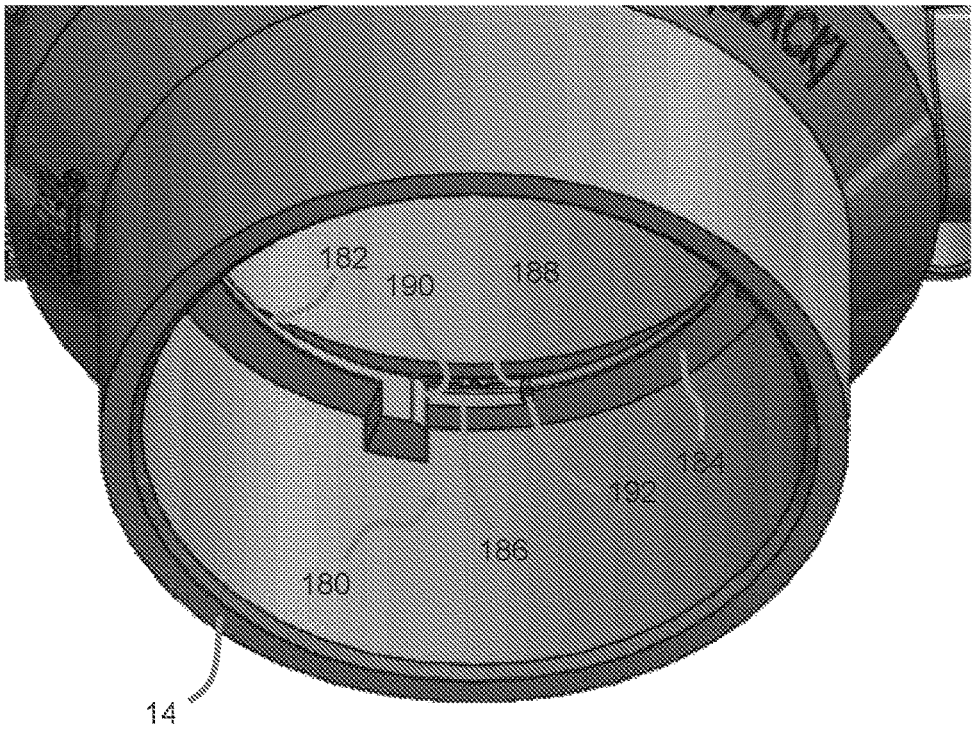
FIG. 10E is a bottom perspective view of a portion of the locking mechanism shown in FIG. 10D.
Figure 10F:
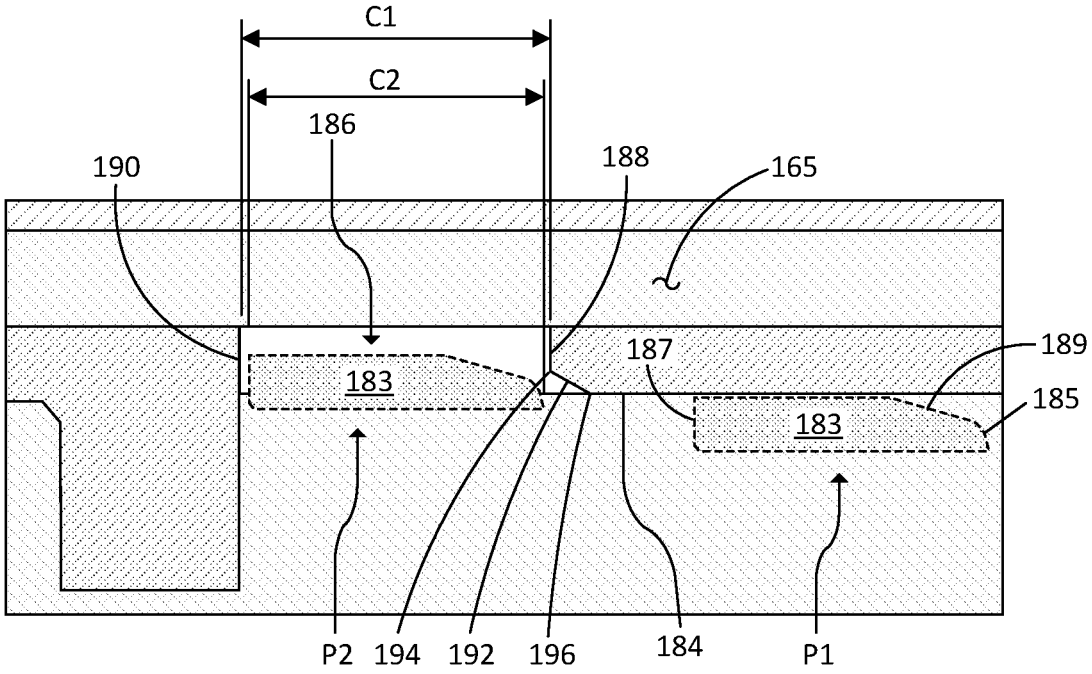
FIG. 10F is a diagram elevation view showing inter-operation of the locking mechanisms of the test plug and the drain body.
Figure 11A:
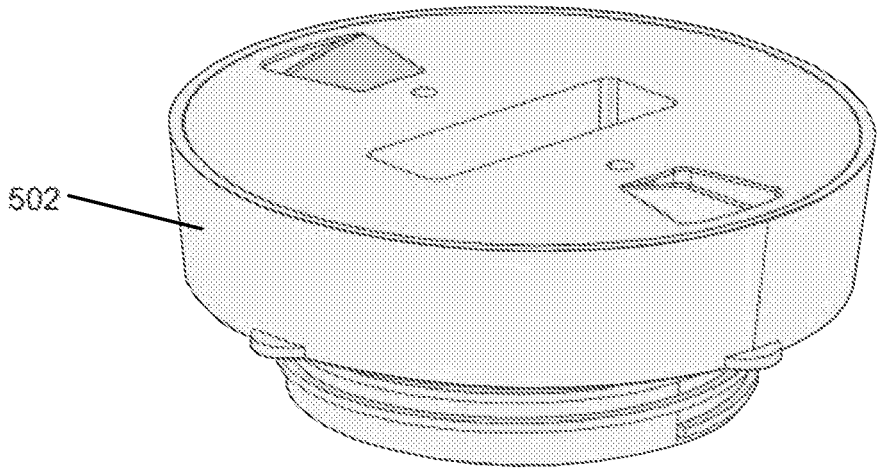
FIG. 11A is a top perspective view of a cap assembly that includes a cap plug and an exterior sleeve for use with a drain assembly.
Figure 11B:
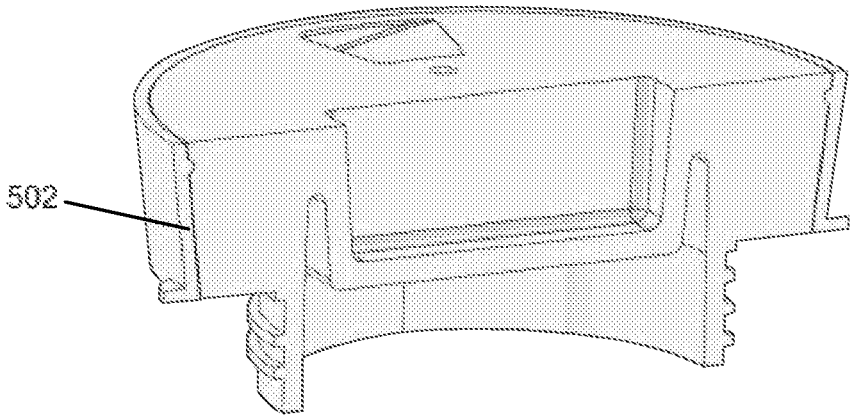
FIG. 11B is a sectional perspective view of the cap assembly shown in FIG. 11A.

Referring now to FIGS. 10D-10F, the intermediate portion 37 of the drain body 4 defines a locking mechanism 180 that is engageable with a locking mechanism 181 of the test plug 22. For purposes of discussion, the locking mechanism 180 of the drain body 4 can be referred to as a first locking mechanism 180, and the locking mechanism 181 of the test plug 22 can be referred to as a second locking mechanism 181. The first locking mechanism 180 is spaced between the plug seat 165 and the bottom end 14 of the drain body 4. The first locking mechanism 180 includes an annular protrusion 182 extending radially inward from the interior drain surface 6. The first locking mechanism 180 includes a stop surface 184 that extends annularly along an underside of the annular protrusion 182 and faces the bottom end 14 of the drain body 4.

The first locking mechanism 180 includes a plurality of slots 186 extending axially through the annular protrusion 182. In the illustrated embodiment, the first locking mechanism has four (4) slots spaced at 90-degree intervals along the annular protrusion. Each slot 186 extends circumferentially from a first end surface 188 to an opposed second end surface 190, which are defined by the annular protrusion 182. As shown in FIG. 10F, each slot 186 has a circumferential slot length C1 measured between the respective first and second end surfaces 188, 190.

The second locking mechanism 181 includes a plurality of locking protrusions 183 that extend radially outward from the cylindrical exterior surface 179 of the plug body 170. Each locking protrusion 183 extends circumferentially from a first protrusion end 185 to an opposed second protrusion end 187. In this manner, each locking protrusion 183 has a circumferential protrusion length C2 measured between the respective first and second ends 185, 187. Each locking protrusion 183 also has a top protrusion surface 189 extending circumferentially from the first protrusion end 185 to the second protrusion end 187. In the illustrated embodiment, the top protrusion surface 189 tapers upwardly from the first protrusion end 185 toward the second protrusion end 187.

Referring now to FIG. 10F, the circumferential protrusion lengths C2 of the locking protrusions 183 are less than the circumferential slot lengths C1, thereby allowing the locking protrusions 183 to translate axially through the slots 186, respectively, when the locking protrusions 183 are axially aligned with the slots 186. The test plug 22 is rotatable about the central axis 10 to move the second locking mechanism 181 between a first operative position P1 (i.e., a locked position) and a second operative position P1 (i.e., an unlocked position). In the first operative position P1, the plug gasket 24 is sealed against the plug seat 165 (see FIG. 10C) and the locking protrusions 183 underly the stop surface 184, thereby inhibiting upward axially movement of the test plug 22 relative to the drain body 4.

In the second operative position P2, the locking protrusions 183 are axially aligned with the slots 186 and are thus unobstructed by the stop surface 184. This allows the test plug 22 to be upwardly axially movable relative to the drain body 4 when in the second operative position P2. In the illustrated embodiment, the test plug 22 is rotatable back-and-forth between the first and second operative positions P1, P2 along respective partial revolutions no greater than 90-degrees about the central axis 10.

To facilitate a strong seal between the gasket 24 and the plug seat 165, each first end surface 188 of the respective slot 186 is contiguous with a ramp surface 192. Each ramp surface 192 extends circumferentially from a first ramp end 194 at an interface with the first end surface 188 to a second ramp end 196. The second ramp end 196 is contiguous with the stop surface 184. The ramp surfaces 192 are each angled downward from the first ramp end 194 to the second ramp end 196. The ramp surfaces 192 are configured to guide a respective one of the locking protrusions axially downward as the second locking mechanism transitions from the first operative position P1 to the second operative position P2.

It should also be understood that the various drain assemblies described above can be provided in various kits. The kit preferably includes the pre-pour and post-pour assemblies 2*a*, 2*b*. It should also be understood that any such kit can include various interchangeable components, such as extender barrels, deck flanges, waterproofing flanges, different grate types (e.g., round, square, etc.), leveling assemblies, and the like.

It should further be understood that the drain assemblies described herein can be provided in different respective size categories. In this manner, the drain assemblies and their respective components described herein can be scaled upward or downward in size as needed.

An exemplary method for assembling a drain now be described. It should be understood that the following steps represent non-limiting examples of process steps for assembling a drain having various structural features as described throughout this disclosure.

The method includes providing a drain body 4, an upper barrel 16, an annular gasket 20, and a plug 18. The drain body 4 has an interior drain surface 6 that defines a drain channel 8 extending along a central axis 10. The drain channel 6 extends between a top end 12 and a bottom end 14 of the drain body 4. The interior drain surface 6 has an upper receptacle portion 36 extending downwardly from the top end 12. The upper barrel 16 has a central body 62 and a flange 76 extending radially outward from an upper end 64 of the central body 62. The flange 76 defines a top surface 78. The central body 62 has an exterior barrel surface 68 opposite an interior barrel surface 70. The interior barrel surface 70 defines a barrel channel 72. The plug 18 has a top wall 84 and an outer plug body 88 extending axially from the top wall 84. The outer plug body 88 has a stop surface 90 opposite the top wall 84 and also has an inner portion 92 extending axially below the stop surface 90. The annular gasket 20 has a top gasket surface and an axially opposed bottom gasket surface.

The drain body 4 is placed over a substrate 52. For example, the drain body 4 can be placed atop a drain pipe 35 (see FIG. 2D) or suspended over an opening in the substrate 52 (see FIGS. 8B and 9B). The central body 62 of the upper barrel 16 is inserted into the upper receptacle portion 36 of the drain body 4, thereby aligning the barrel channel 72 with the central axis 10 of the drain body 4. The user axially adjusts a position of the central body 62 of the upper barrel 16 relative to the drain body 4, thereby adjusting a distance H between the top end 12 of the drain body 4 and the top surface 78 of the flange 76. The annular gasket 20 can be placed atop the top surface 78 of the flange 76. The inner portion 92 of the outer plug body 88 is inserted into the barrel channel 72 until the top surface of the annular gasket abuts the stop surface 90 of the plug 18 and the bottom gasket surface abuts the top surface 78 of the flange 76, thereby sealing the outer plug body 88 against the flange 76 for preventing cement from flowing into the barrel channel 72.

Wet cement 100 is poured over the substrate 52 and around the drain body 4, the upper barrel 16, and the plug 18. The wet cement 100 is preferably leveled so that a top surface 86 of the top wall 84 of the plug 18 is substantially level with a top surface 102 of the poured cement 100 and the cement 100 is allowed to harden. The plug 18 is removed after the poured cement 100 has substantially hardened.

The method includes providing a strainer barrel 26 and a drain grate 32. The strainer barrel 26 has a central body 110 having an exterior surface 112 opposite an interior surface 114. The interior surface 114 of the strainer barrel 26 defines a strainer barrel channel 116 that extends from a top end 28 of the strainer barrel 26 to a bottom end 30 of the strainer barrel 26. The drain grate 32 has a top surface 120 and an opposed bottom surface 122.

The central body 110 of the strainer barrel 26 is inserted into the upper receptacle portion 36 of the drain channel 8. A user can then axially adjust a position of the central body 110 of the strainer barrel 26 relative to the drain body 4, such as by axially lowering the position of the central body 110 of the strainer barrel 26 downward relative to the drain body 4.

The drain grate 32 is attached to the top surface 28 of the strainer barrel 26. Optionally, the position of the strainer barrel 26 can be axially adjusted relative to the upper barrel 16 so that the top surface 120 of the drain grate 32 is be recessed from the top surface 102 of the cement 100.

Referring now to FIGS. 11A-15C, in these additional embodiments, the pre-pour sub-assembly includes a sleeve 502 connectable to the exterior plug surface 96 of the cap plug 18. In these embodiments the sleeve 502 is removably attachable to the cap plug 18 and the upper barrel 16. The sleeve 502 will remain in the drain assembly post-pour to provide structural stability to hold up the concrete walls surrounding the sleeve 502, including after the cap plug 18 is removed. The sleeve 502 has an exterior sleeve surface 508 opposite an interior sleeve surface 510. The exterior sleeve surface 508 is configured to engage poured cement and prevent it from entering the upper barrel 16. The interior sleeve surface 510 is configured to interface with the exterior plug surface 96 in a manner preventing poured cement from entering therebetween. The sleeve 502 has a top sleeve surface 512 opposite a bottom sleeve surface 514. The bottom sleeve surface 514 is abuttable with the landing surface 78 of the upper barrel 16 or with a plug gasket 20 axially positioned between the bottom sleeve surface 514 and the landing surface 78.

Figure 12A:
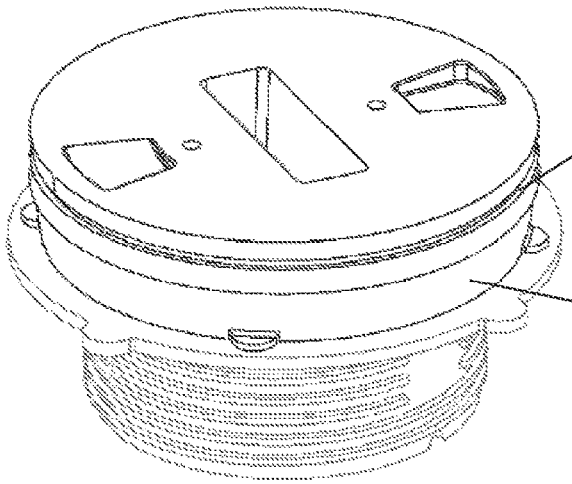
FIG. 12A is a top perspective view of a pre-pour sub-assembly that includes a cap assembly coupled to an adjustable-height upper barrel, wherein the cap assembly includes a cap plug, an exterior sleeve, and a ring.
Figure 12B:
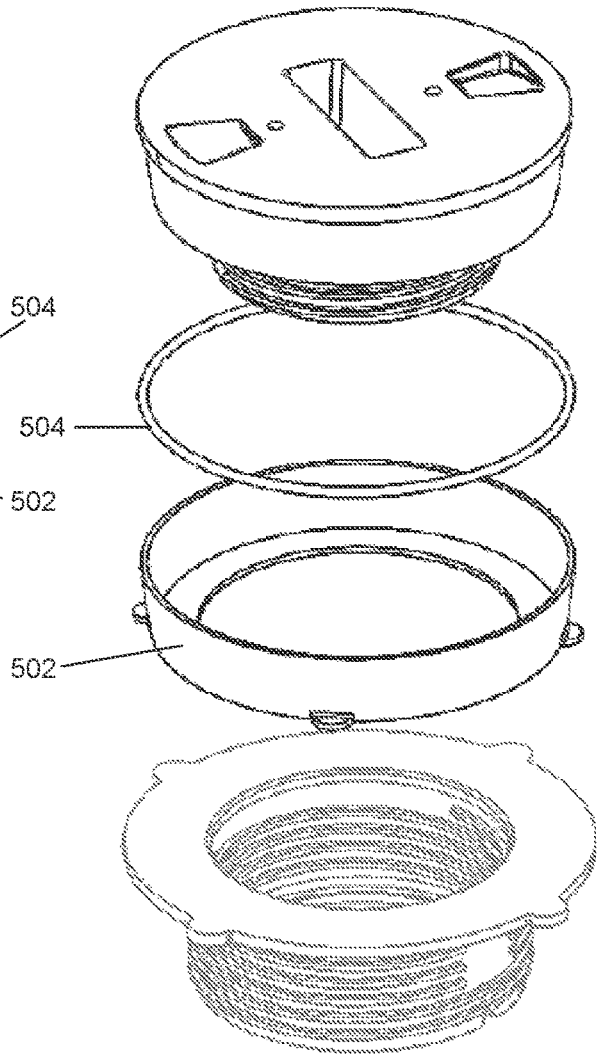
FIG. 12B is an exploded perspective view of the pre-pour sub-assembly shown in FIG. 12A.
Figure 12C:
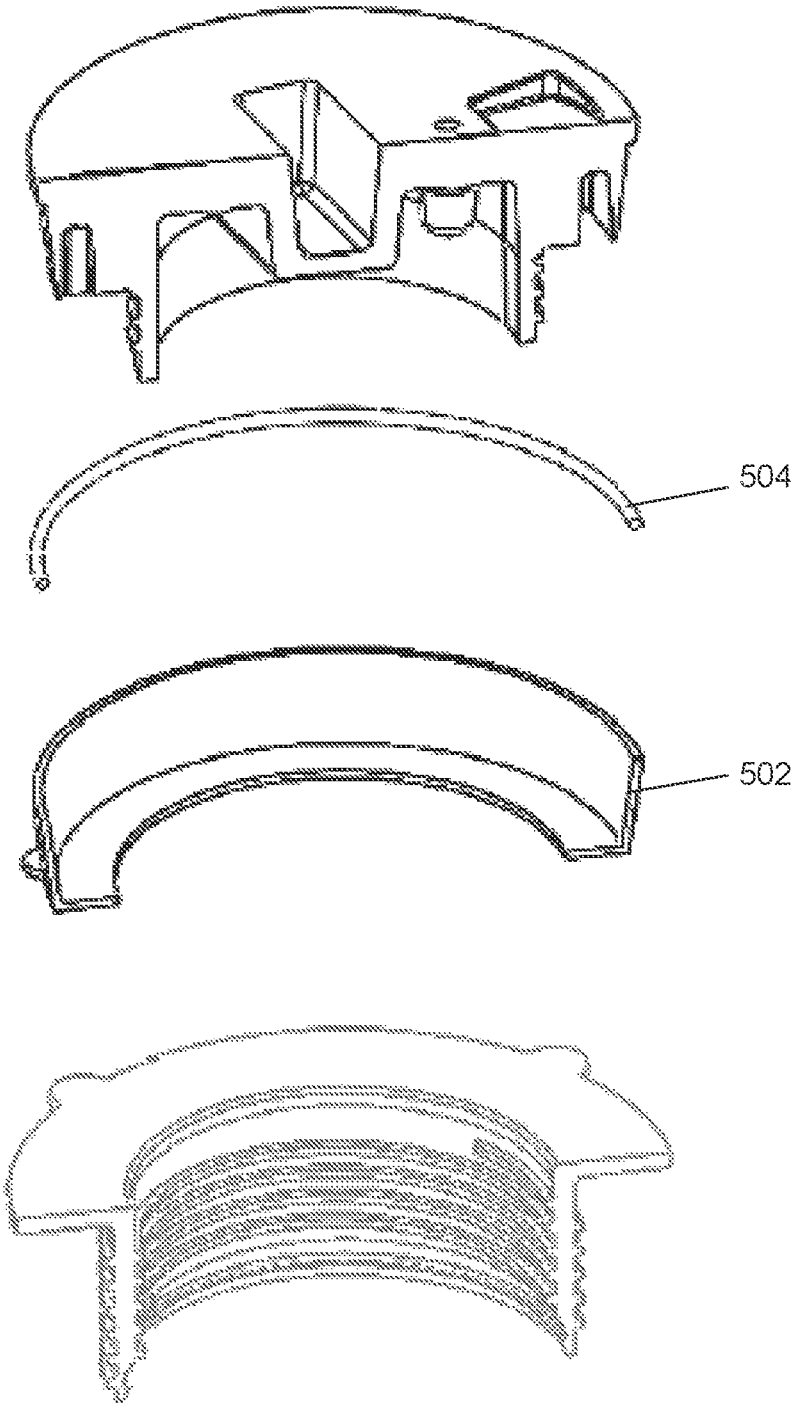
FIG. 12C is a sectional, exploded perspective view of the pre-pour sub-assembly shown in FIG. 12A.

In the embodiment shown in FIGS. 12A-12C, the pre-pour assembly includes a ring member 504 that is separate from the sleeve 502 is attachable directly to the exterior plug surface 96. The ring member 504 is configured to reside around the exterior plug surface 96 and atop the sleeve 502 when coupled to the cap plug 18. In this embodiment, the ring member 504 will also remain in the drain assembly post-pour to provide structural stability to hold up the concrete walls surrounding the sleeve 502 and the ring member 504, including after the cap plug 18 is removed. As shown, the ring member 504 can have a circular cross-sectional geometry. In further embodiments, the ring member 504 can have an elongated, sleeve-like vertical geometry. Thus, in such further embodiments, the ring member 504 can be an additional sleeve.

It should be appreciated that in the additional embodiments shown in FIGS. 12A-12C, 13A-13C, and 14A-14C, the top surface 86 of the cap plug 18 is positioned above a top surface 508 of the sleeve 502 (and above a top surface of the ring member 504 shown in FIGS. 12A-12C) when the cap plug 18 is coupled to the upper barrel 16. It should also be appreciated that, in these additional embodiments (FIGS. 12A-14C), when the post-pour sub-assembly replaces the cap plug 18, the upper surface 120 of the grate 32 will preferably be located above the top surface 508 of the sleeve 502 (and above the top surface of the ring member 504 shown in FIGS. 12A-12C).

Figure 13A:
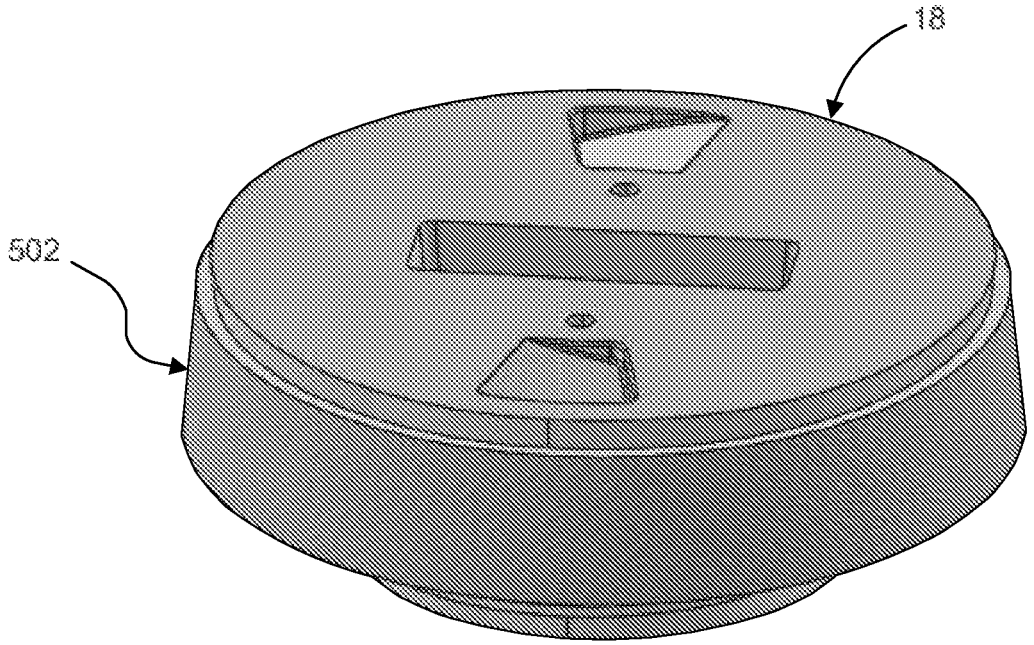
FIG. 13A is a top perspective view of a cap assembly that includes a cap plug and an exterior sleeve for use with a drain assembly.
Figure 13B:
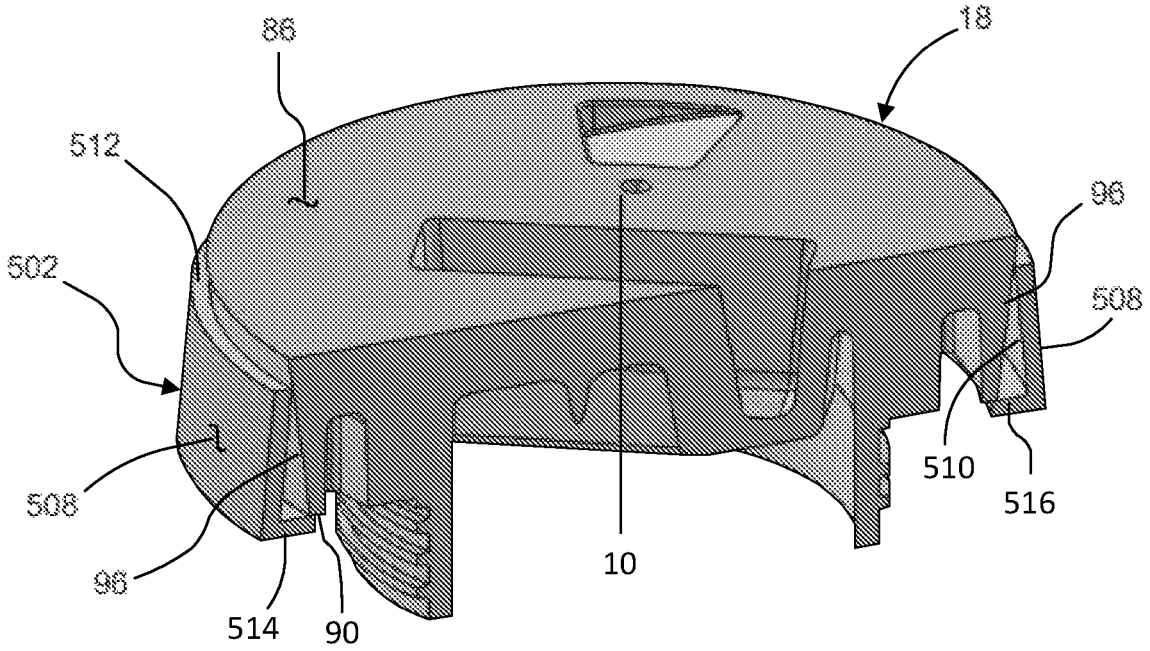
FIG. 13B is a sectional perspective view of the cap assembly shown in FIG. 13A.
Figure 13C:
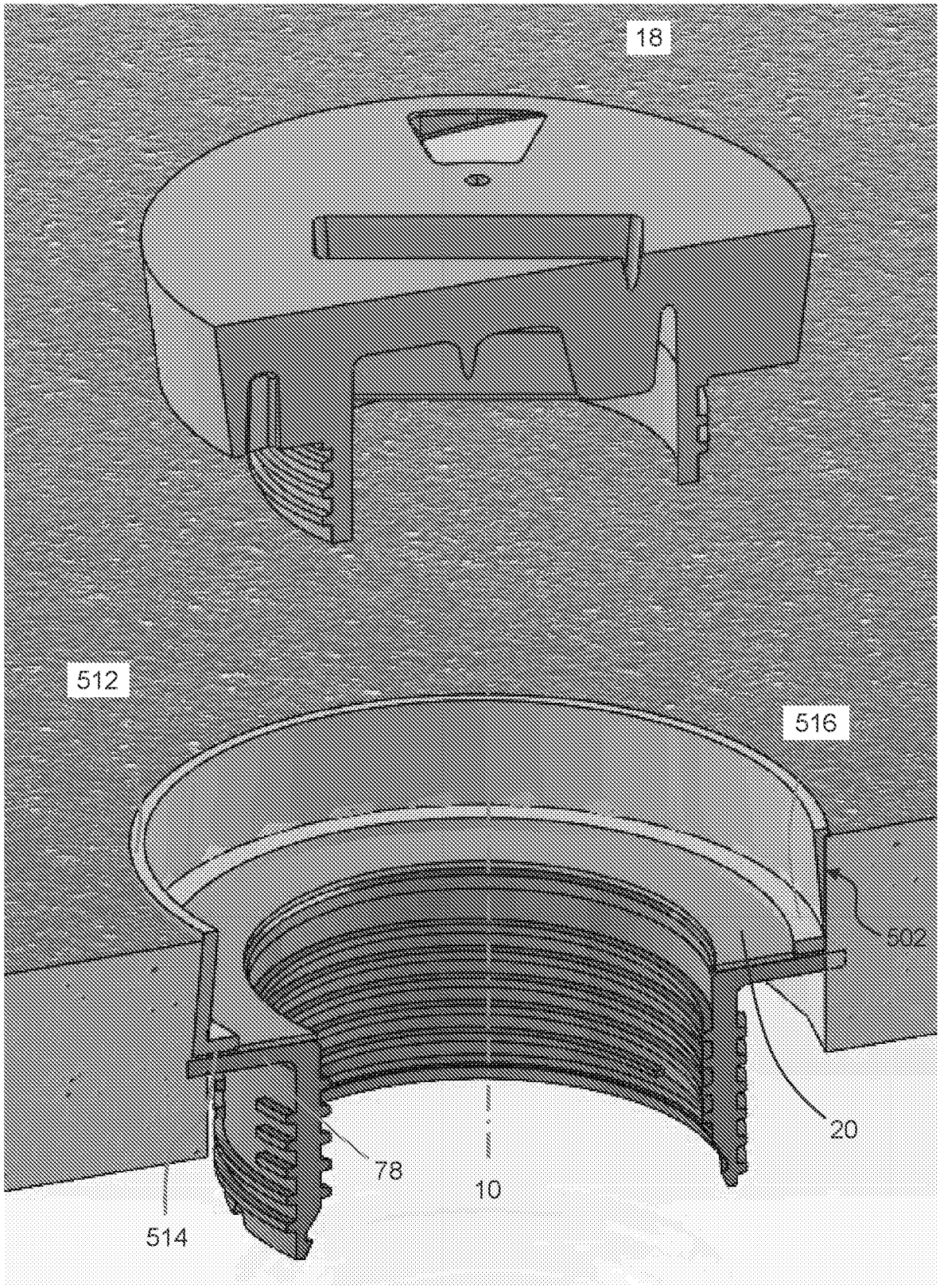
FIG. 13C is a sectional, exploded perspective view showing the cap assembly of FIG. 13A in a partial installation.

Referring now to FIGS. 13A-13C, in additional embodiments, the sleeve 502 has an inner flange portion 516 that extends inwardly from the interior sleeve surface 510 at the bottom of the sleeve 502, such that the bottom sleeve surface 514 extends along a bottom of the inner flange portion 516. As shown in FIG. 13C, the inner flange portion 516 is abuttable with a plug gasket 20 axially positioned between the bottom sleeve surface 514 and the landing surface 78. As best shown in FIGS. 13B-13C, the exterior sleeve surface 508 tapers outwardly (away from the central axis 10) from the top sleeve surface 512 to the bottom sleeve surface 514. The exterior plug surface 96 can taper inwardly (toward the central axis 10) from the top surface 86 of the cap plug 18 to the stop surface 90.

Figure 14A:
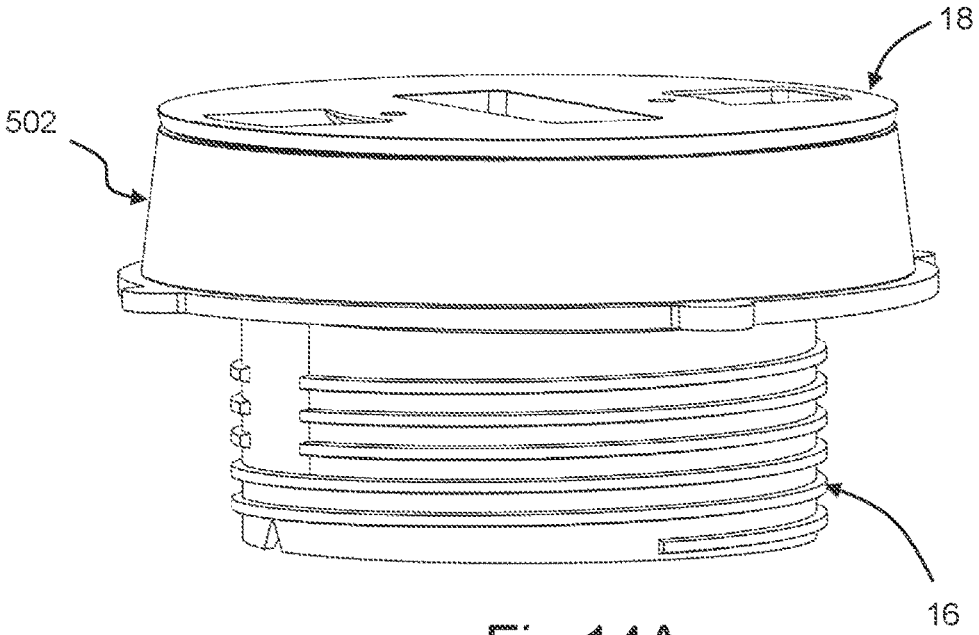
FIG. 14A is a top perspective view of a cap assembly that includes a cap plug and an exterior sleeve for use with a drain assembly, wherein the cap plug has a stop surface that seats atop the sleeve.
Figure 14B:
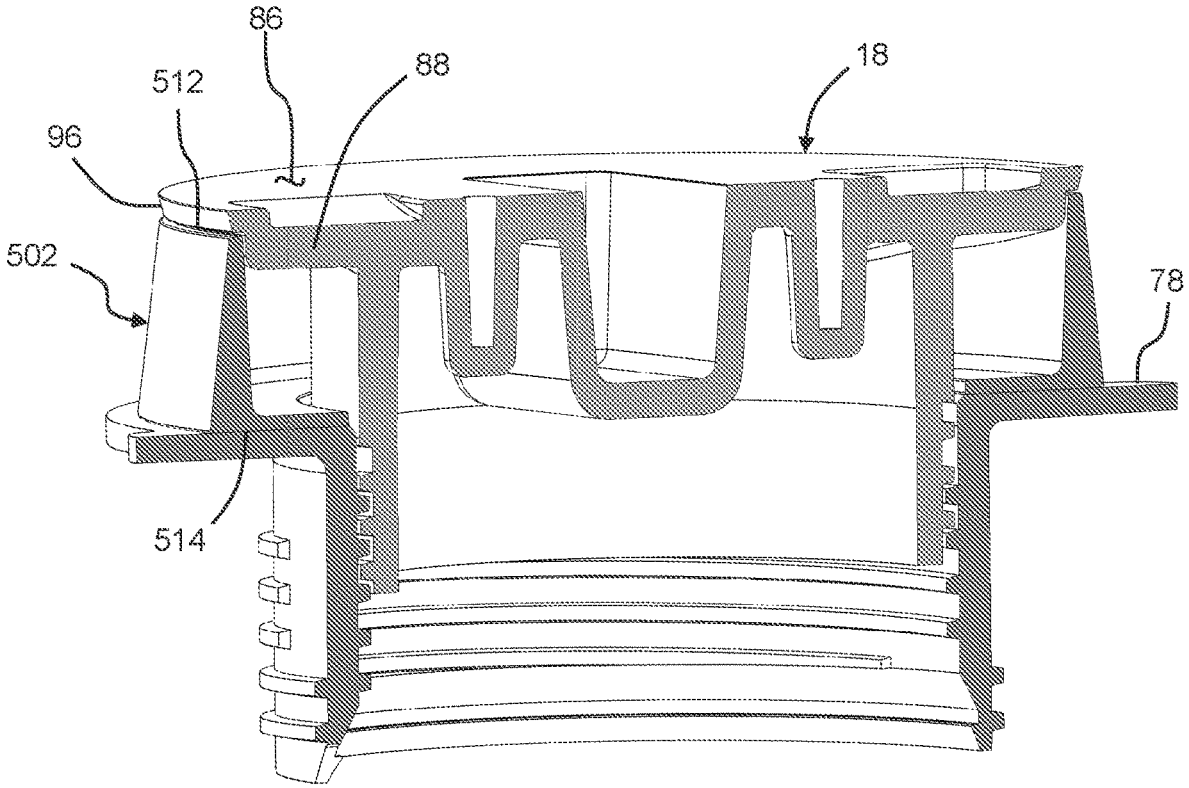
FIG. 14B is a sectional perspective view of the cap assembly shown in FIG. 14A.
Figure 14C:
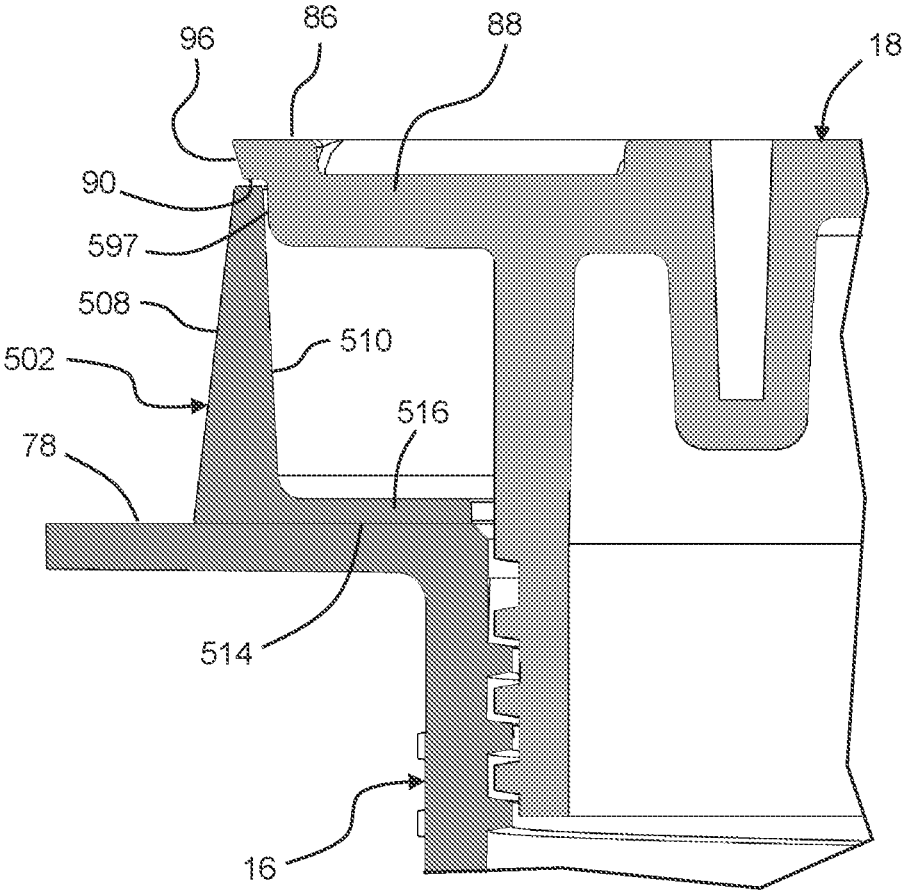
FIG. 14C is a sectional side view of a portion of the cap assembly shown in FIG. 14A.

Referring now to FIGS. 14A-14C, in another embodiment, the stop surface 90 of the outer body 88 of the cap plug 18 is abuttable with the top sleeve surface 512. As in other embodiments above, the exterior cap surface 96 tapers inwardly from the top surface 86 of the cap plug 18 to the stop surface 90. In the present embodiment, the stop surface 90 provides mechanical interference with the top sleeve surface 512 that maintains an elevated position of the top surface 86 of the cap plug 18 above the top sleeve surface 512. The outer body 88 of the cap plug 18 can also define a second exterior surface 597 that extends downward below the stop surface 90 and is positioned inward of the exterior cap surface 96. The second exterior surface 597 can interface with the interior sleeve surface 510. The second exterior surface 597 and the stop surface 90 of the present embodiment effectively provide a shoulder for the cap plug 18 that seats against an upper portion of the sleeve 502.

Figure 15A:
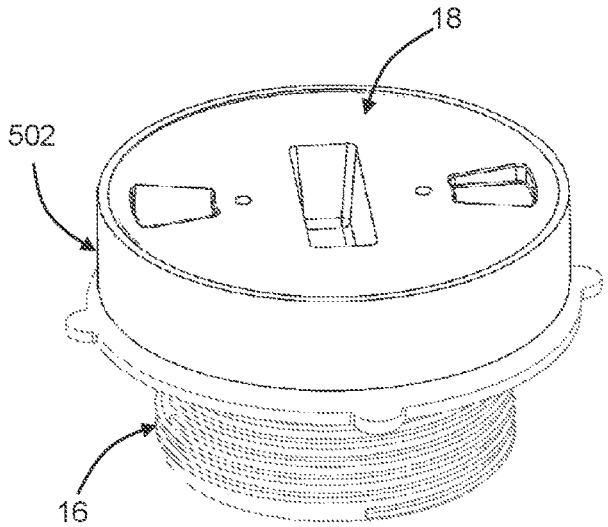
FIG. 15A is a top perspective view of a pre-pour sub-assembly that includes a cap assembly coupled to an adjustable-height upper barrel, wherein the cap assembly includes a cap plug and an exterior sleeve.
Figure 15B:
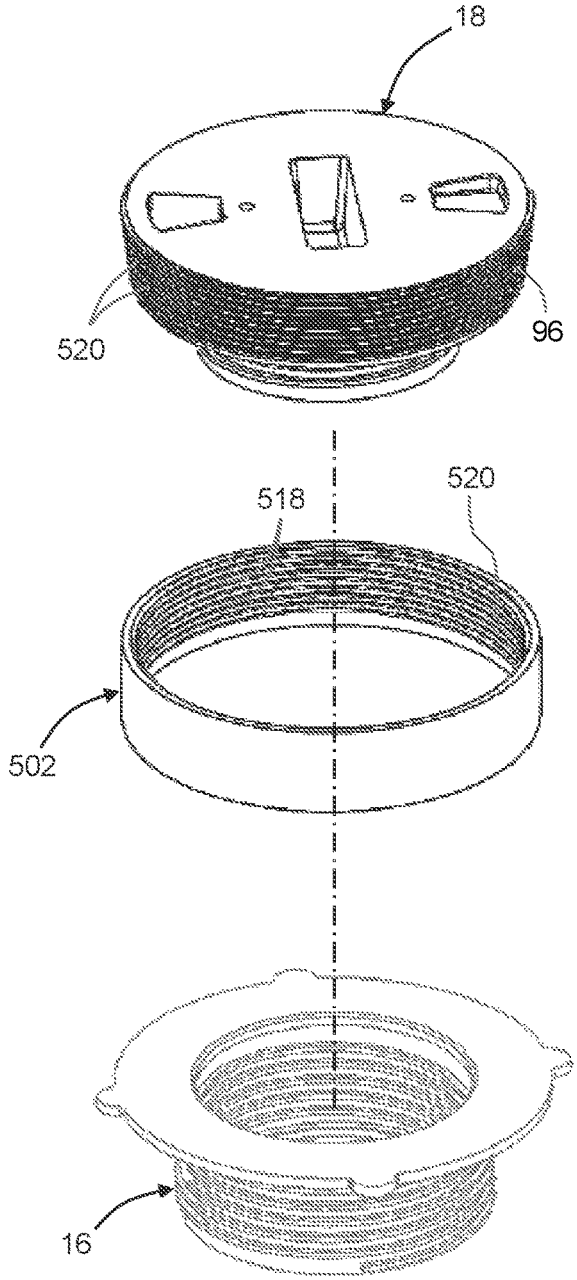
FIG. 15B is an exploded perspective view of the pre-pour sub-assembly shown in FIG. 15A.
Figure 15C:
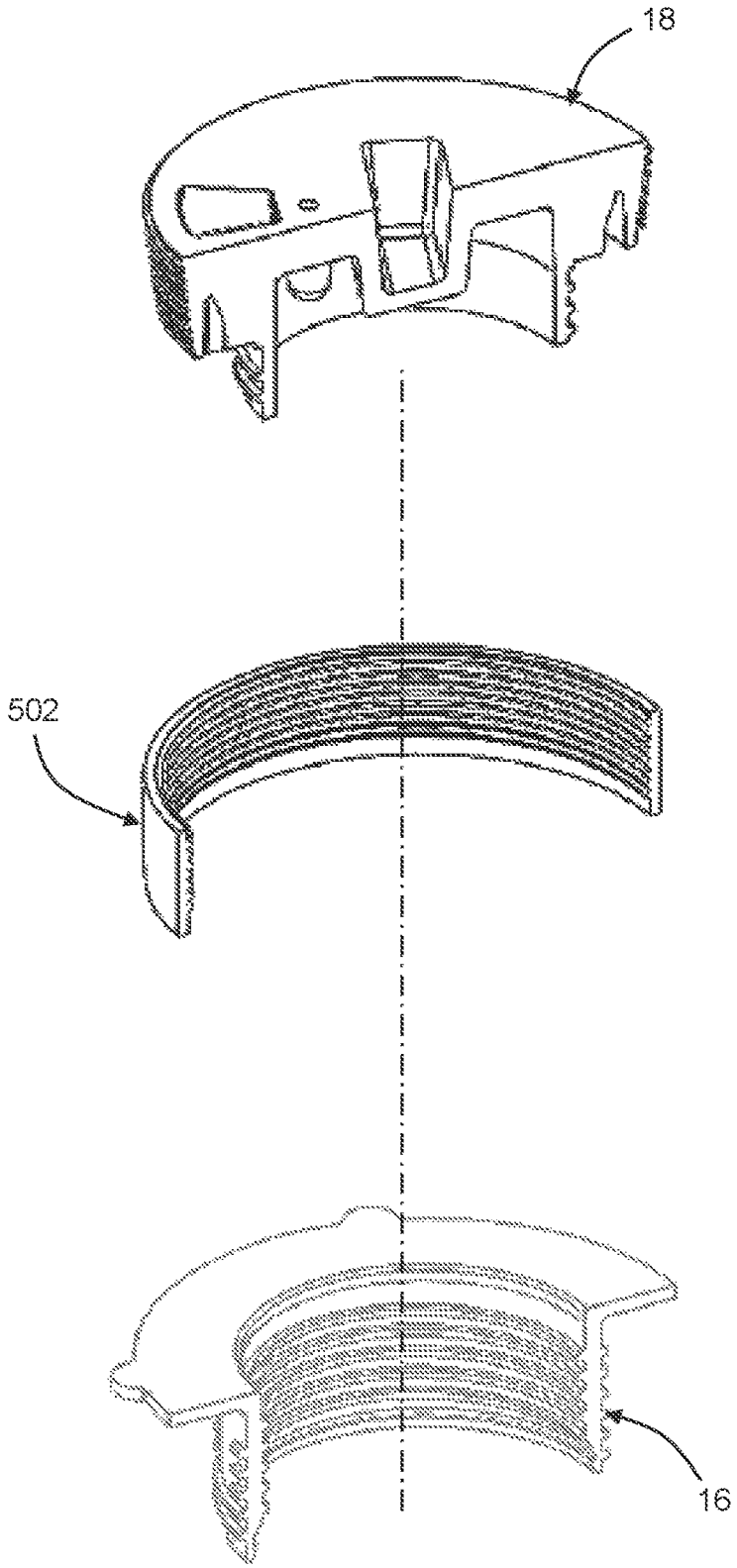
FIG. 15C is a sectional, exploded perspective view of the pre-pour sub-assembly shown in FIG. 15A.

Referring now to FIGS. 15A-15C, in additional embodiments, the interior sleeve surface 510 can have interior threads 518 that are engageable with additional exterior threads 520 on the exterior plug surface 96 for coupling the sleeve 502 with the cap plug 18.

Figure 16A:
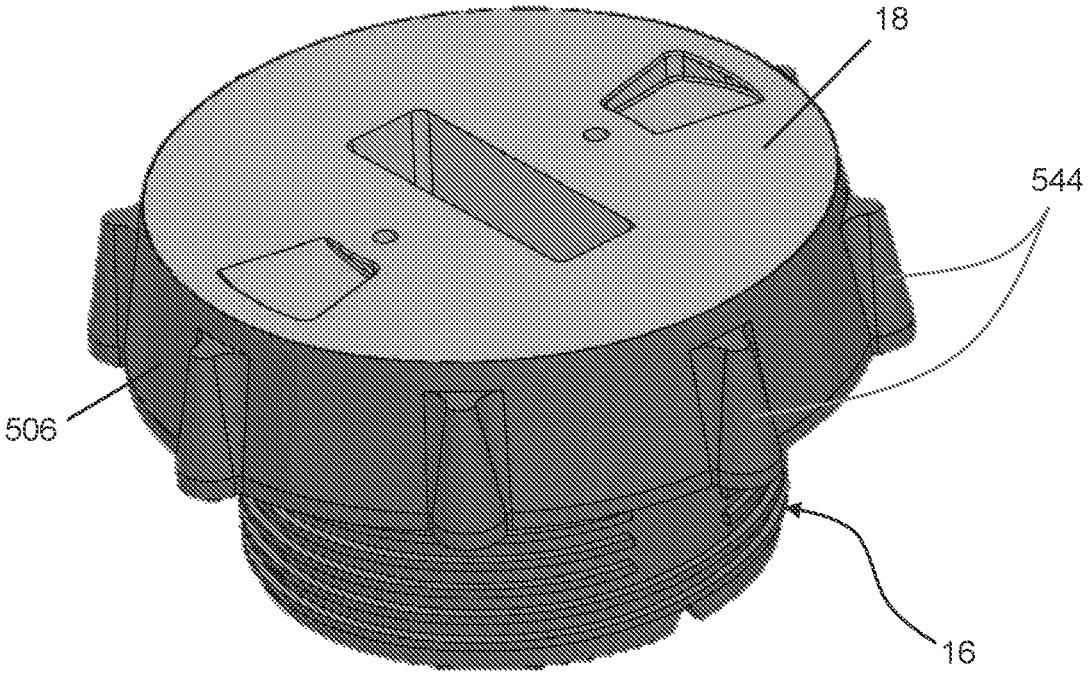
FIG. 16A is a top perspective view of a pre-pour sub-assembly that includes a cap plug coupled to an adjustable-height upper barrel that has an upper sleeve portion having outward protrusions.
Figure 16B:
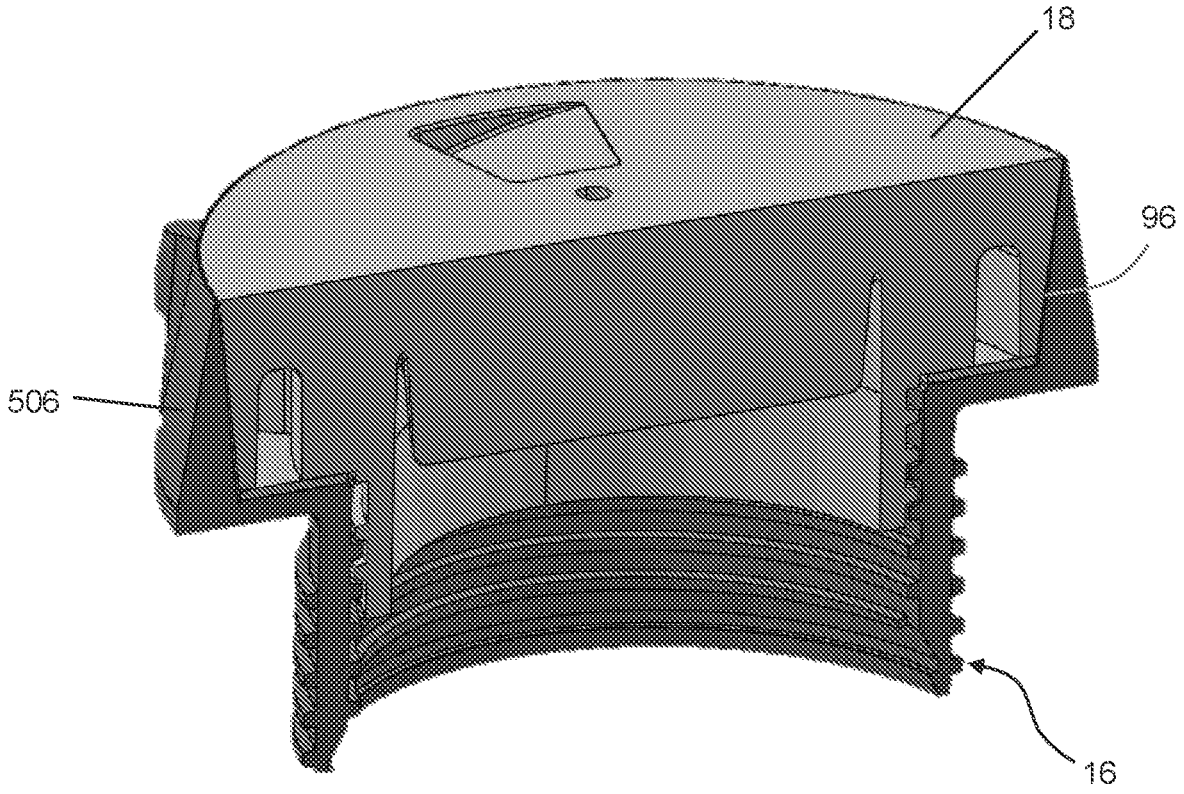
FIG. 16B is a sectional perspective view of the pre-pour sub-assembly shown in FIG. 16A, showing an interior gasket disposed between the cap plug and upper barrel.
Figure 16C:
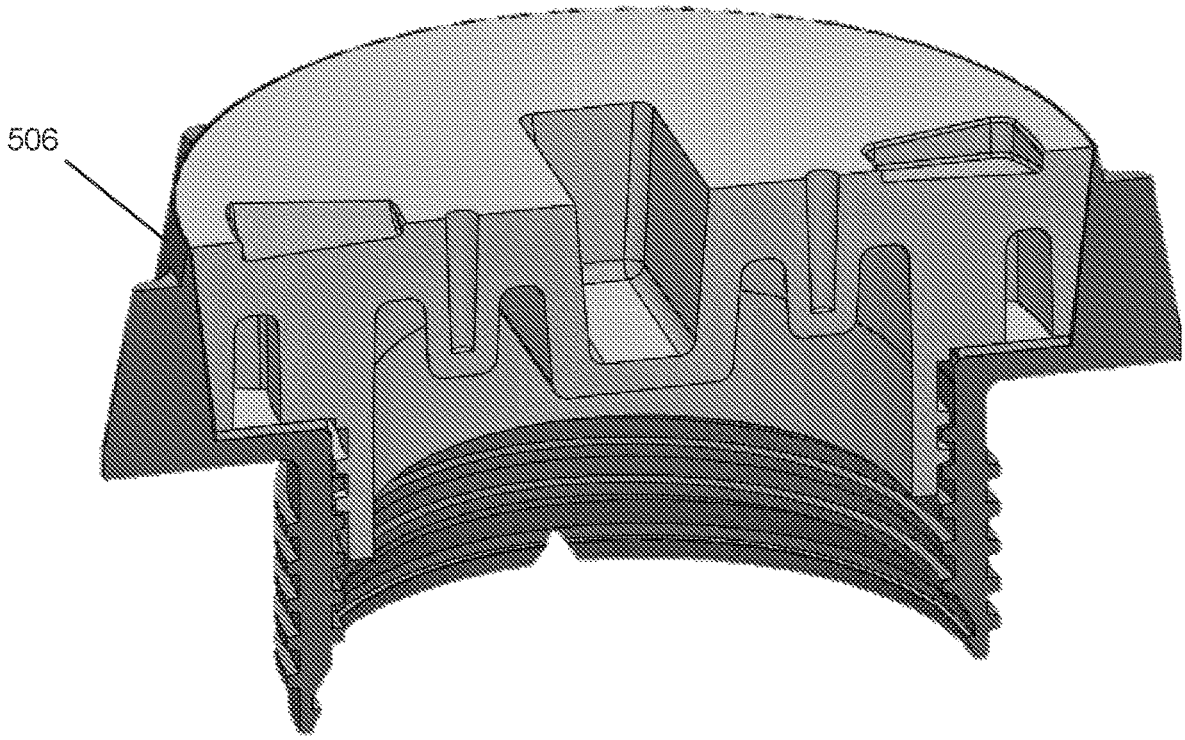
FIG. 16C is another sectional perspective view of the pre-pour sub-assembly shown in FIG. 16A, taken orthogonally to the section view shown in FIG. 16B.

Referring now to FIGS. 16A-16C, in yet additional embodiments, the upper barrel 16 includes an upper sleeve member 506 that extends upward and around the exterior plug surface 96. In the illustrated embodiment, the upper sleeve member 506 is monolithic with the remainder of the upper barrel 16, and will therefore remain in the drain assembly after the cap plug 18 is removed. As shown, the upper sleeve member 506 can have exterior protrusions 544, which can lock within the concrete post-pour.

It should also be understood that the present disclosure encompasses various other methods and techniques for assembling a drain.

It should be appreciated that the various parameters of the drain assemblies and their respective components described above are provided as exemplary features for adapting the drain assemblies as needed. These parameters can be adjusted as needed without departing from the scope of the present disclosure.

Although the disclosure has been described in detail, it should be understood that various changes, substitutions, and alterations can be made herein without departing from the spirit and scope of the invention as defined by the appended claims. Moreover, the scope of the present disclosure is not intended to be limited to the particular embodiments described in the specification. In particular, one or more of the features from the foregoing embodiments can be employed in other embodiments herein. As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed is:

1. A drain assembly, comprising:

a drain body defining an interior drain surface that defines a drain channel extending along a central axis, wherein an upper receptacle portion of the interior drain surface defines interior threads;

an upper barrel having a central body and a flange extending radially outward from an upper end of the central body, the flange defining a landing surface, the central body having an exterior barrel surface opposite an interior barrel surface, the interior barrel surface defining a barrel channel alignable with the central axis of the drain body, the central body having interior threads formed on the interior barrel surface and exterior threads formed on the exterior barrel surface adjacent to a lower end thereof, the exterior threads being engageable with the interior threads of the drain body, wherein the upper barrel is axially adjustable relative to the drain body along the central axis;

a plug having a top surface, an outer body extending axially downward from the top surface, the outer body defining a stop surface opposite the top surface, the outer body including an inner portion extending axially below the stop surface, the inner portion having external threads engageable with the interior threads of the upper barrel; and a sleeve comprising a sidewall portion comprising an upper end, a lower end, a sidewall inner face, and a flange portion that projects radially inward from the lower end of the sidewall portion, the flange portion of the sleeve being axially receivable between the stop surface of the plug and the landing surface of the upper barrel.

2. The drain assembly of claim 1, wherein the outer body of the plug defines an exterior plug surface that extends from the top surface to the stop surface, and the exterior plug surface is engageable with cement during the cement pouring phase.

3. The drain assembly of claim 2, wherein the exterior surface plug surface tapers inwardly toward the central axis from the top surface to the stop surface.

4. The drain assembly of claim 2, wherein the sleeve comprises:

an exterior sleeve surface opposite an interior sleeve surface;

a top sleeve surface opposite a bottom sleeve surface; and an inner flange portion extending inwardly from the interior sleeve surface, wherein the bottom sleeve surface extends along a bottom of the inner flange portion, and the bottom sleeve surface is abuttable with the landing surface of the upper barrel.

5. The drain assembly of claim 2, wherein the sleeve comprises:

an exterior sleeve surface opposite an interior sleeve surface, and a top sleeve surface opposite a bottom sleeve surface, wherein the exterior sleeve surface tapers outwardly away from the central axis from the top sleeve surface to the bottom sleeve surface.

6. The drain assembly of claim 2, wherein the plug is constructed of a material for providing a non-binding contact interface between the exterior plug surface and the cement.

7. The drain assembly of claim 6, wherein the material comprises acetal plastic.

8. The drain assembly of claim 2, wherein the exterior plug surface is coated with a layer of coating material configured to provide a non-binding contact interface with the cement.

9. The drain assembly of claim 8, wherein the coating material is selected from the group comprising polyvinyl alcohol, mineral oil, silicone, polysiloxane, wax, and polytetrafluoroethylene (PTFE).

10. The drain assembly of claim 2, wherein the plug is interchangeable with a strainer barrel, the strainer barrel having a central body insertable within the barrel channel, the central body of the strainer barrel having an exterior surface opposite an interior surface, the interior surface of the strainer barrel defining a strainer barrel channel alignable with the central axis of the drain body, wherein the exterior surface of the central body of the strainer barrel has exterior threads engageable with the interior threads on the interior barrel surface, and wherein the strainer barrel is axially adjustable relative to the upper barrel.

11. The drain assembly of claim 1, wherein the external threads of the plug are removably engageable with the interior threads of the upper barrel, such that the plug is removably attachable to the upper barrel during a pre-pour phase of drain assembly.

12. The drain assembly of claim 11, wherein, in a first operative configuration of the drain assembly, the plug is fully seated within the barrel channel, the top surface of the plug is spaced upwardly from the barrel landing surface at a first distance along the axial direction.

13. The drain assembly of claim 12, further comprising a drain grate attachable to a top end of the strainer barrel, wherein, when the drain grate is attached to the strainer barrel and the strainer barrel is attached to the upper barrel, a top surface of the drain grate is spaced upwardly from the barrel landing surface at a second distance along the axial direction, wherein the second distance is less than the first distance.

14. The drain assembly of claim 13, wherein, in a second operative configuration of the drain assembly, the relative position between the drain body and the upper barrel is rigidly fixed, such that the strainer barrel being axially adjustable relative to the upper barrel causes the second distance to be adjustable while the barrel landing surface has a fixed position relative to the drain body.

* * * * *